US008433211B2

(12) United States Patent
Horike et al.

(10) Patent No.: US 8,433,211 B2
(45) Date of Patent: Apr. 30, 2013

(54) DEVELOPING DEVICE, PROCESS CARTRIDGE, AND IMAGE FORMING APPARATUS

(75) Inventors: Masanori Horike, Kanagawa (JP); Tetsuro Hirota, Kanagawa (JP); Atsushi Kurokawa, Kanagawa (JP); Hideki Kosugi, Kanagawa (JP); Masaaki Yamada, Tokyo (JP); Yoshiko Ogawa, Tokyo (JP); Yuji Ishikura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 316 days.

(21) Appl. No.: 12/879,390

(22) Filed: Sep. 10, 2010

(65) Prior Publication Data

US 2011/0064432 A1 Mar. 17, 2011

(30) Foreign Application Priority Data

Sep. 14, 2009 (JP) ..... 2009-211499
Dec. 7, 2009 (JP) ..... 2009-277640

(51) Int. Cl.
*G03G 15/06* (2006.01)

(52) U.S. Cl.
USPC ..... 399/55

(58) Field of Classification Search ..... 399/44, 399/53, 55, 290, 291
See application file for complete search history.

(56) References Cited

U.S. PATENT DOCUMENTS 5,268,259 A * 12/1993 Sypula ..... 430/311
5,799,234 A 8/1998 Furuya et al.
6,208,825 B1 * 3/2001 Hays ..... 399/266
6,580,882 B2 * 6/2003 Hirsch et al. ..... 399/58
6,708,014 B2 3/2004 Miyaguchi et al.
6,934,496 B2 8/2005 Sakuma et al.
7,308,222 B2 12/2007 Nakagawa et al.
2007/0086811 A1 4/2007 Tsukamoto et al.
2008/0089720 A1 4/2008 Tsukamoto et al.
2008/0089723 A1 4/2008 Tsukamoto et al.
2008/0286015 A1 11/2008 Kadota et al.

FOREIGN PATENT DOCUMENTS

EP 0 414 455 A2 2/1991
JP 3-21967 1/1991
JP 3-100575 4/1991

(Continued)

OTHER PUBLICATIONS

U.S. Appl. No. 12/121,122, filed May 15, 2008, Kadota, et al.

*Primary Examiner* — David Gray
*Assistant Examiner* — Gregory H Curran
(74) *Attorney, Agent, or Firm* — Oblon, Spivak, McClelland, Maier & Neustadt, L.L.P.

(57) ABSTRACT

A disclosed developing device includes a toner carrying member having electrodes, a toner supply unit supplying the toner to the toner carrying member, and a hopping electric field generator unit generating electric field to cause the toner hopping on the toner carrying member by applying a pulse voltage to the electrodes. The hopping electric field generator unit includes a pulse voltage generator circuit generating the pulse voltage, a first direct-current power source supplying bias to the pulse voltage generator circuit for regulating a peak value of the pulse voltage, and a second direct-current power source having a same polarity with a toner charging polarity, and outputting a variable voltage level. The hopping electric field generator unit controls the peak value of the pulse voltage by changing an output of the first power source and a mean thereof by changing an output of the second power source.

19 Claims, 24 Drawing Sheets

FOREIGN PATENT DOCUMENTS

| | | |
|---|---|---|
| JP | 3-113474 | 5/1991 |
| JP | 9-269661 | 10/1997 |
| JP | 2002-341656 | 11/2002 |
| JP | 2003-15419 | 1/2003 |
| JP | 2003-21967 | 1/2003 |
| JP | 2007-133387 | 5/2007 |
| JP | 3996363 | 8/2007 |
| JP | 4139714 | 6/2008 |
| JP | 2010-181644 | 8/2010 |

* cited by examiner

DEVELOPING DEVICE, PROCESS CARTRIDGE, AND IMAGE FORMING APPARATUS

BACKGROUND OF THE INVENTION

1. Field of the Invention

The invention relates to a developing device for use in an image forming apparatus such as a printer, a facsimile machine and a copier, a process cartridge having the developing device, and an image forming apparatus having the process cartridge.

2. Description of the Related Art

It is generally known in the art that there is an image forming apparatus that employs a hopping developing system. The hopping developing system develops images while toner is hopping on a surface of a toner carrying member. An example of such an image forming apparatus having such a hopping developing system is disclosed in Japanese Patent Application Publication No. 2007-133387. The disclosed image forming apparatus includes a tubular toner carrying member having plural popping electrodes arranged at a predetermined pitch in a peripheral direction of the tubular toner carrying member. In the tubular toner carrying member, A-phase repetitive pulses are applied to the hopping electrodes arranged at even numbered arrangement positions while B-phase repetitive pluses differing from the A-phase repetitive pulses are applied to the hopping electrodes arranged at odd numbered arrangement positions. With this configuration, alternating electric field is generated between the adjacent hopping electrodes to act on the toner to generate electrostatic force such that the generated electrostatic force causes the toner to perform hopping behaviors between the adjacent hopping electrodes. The toner hopping between the adjacent hopping electrodes on the surface of the toner carrying member is then transferred onto a latent image formed on a latent image carrying member to thereby complete the development.

Various experiments have been conducted on the image forming apparatus having the above hopping developing system, and these results have shown that image density, which is generally determined based on a peak value of a pulse voltage, varies with the change in the peak value of the pulse voltage applied to the hopping electrodes. That is, these results have shown that the field intensity near the surface of the latent image carrying member is changed due to the difference in the mean of the pulse voltage when the peak value of the pulse voltage is applied to the hopping electrodes, and the density of the image formed on the latent image carrying member is changed based on the change in the field intensity near the surface of the latent image carrying member.

Note that the change in the peak value of the pulse voltage may result from an environmental change during image forming operation. For example, if the image forming operation is conducted under a high-humidity environment, adhesive force between the toner and the surface of the toner carrying member may be increased due to an increase in liquid cross-linking force, or the electrostatic force generated by the alternating electric field acting on the toner may be decreased due to a decrease in a charging amount of the toner resulting from lowered toner charging efficiency. The above adverse effects inhibit the toner from hopping on the surface of the toner carrying member, causing a decrease in the amount of toner to be transferred on a latent image portion of the image carrying member. As a result, the image density is lowered. If, on the other hand, the image forming operation is conducted under a low-humidity environment, adhesive force between the toner and the surface of the toner carrying member may be reduced due to a decrease in liquid cross-linking force, or the electrostatic force generated by the alternating electric field acting on the toner may be increased due to an increase in a charging amount of the toner resulting from increased toner charging efficiency. In this case, toner is hopping too much to jump up too high on the toner carrying member, which may result in undesired toner adherence to a non-image forming portion of the image carrying member where no electrostatic latent image is formed. That is, toner hopping too high on the surface of the toner carrying member may contaminate the non-image forming portion of the image carrying member (i.e., a base surface of the image forming member).

Further, in addition to the above developing device disclosed in Japanese Patent Application Publication No. 2007-133387, another developing device is also generally known in the art. In the developing device disclosed in Japanese Patent Application Publication No. 2007-133387, hopping toner reciprocates between the adjacent hopping electrodes while the hopping toner is transferred onto a developing region by a surface movement of the toner carrying member. However, in the latter developing device, toner on the surface of the toner carrying member is transferred to the developing region by hopping movements of the toner itself in a predetermined direction. For example, in the developing device having a toner carrying member on which A-phase, B-phase, and C-phase electrodes are repeatedly arranged in this order, toner on the surface of the toner carrying member is caused to perform hopping movements to sequentially transfer the toner on the surface of the toner carrying member from A-phase electrode to B-phase electrode, from B-phase electrode to C-phase electrode, from C-phase electrode to A-phase electrode, and finally to the developing region. However, this type of the developing device may also have similar drawbacks.

SUMMARY OF THE INVENTION

It is a general object of at least one embodiment of the present invention to provide a developing device, a process cartridge having the process cartridge, and an image forming apparatus having the process cartridge that substantially eliminate one or more problems caused by the limitations and disadvantages of the related art. Specifically, the embodiment attempts to provide a developing device capable of inhibiting fluctuation in image density formed on an image carrying member, a process cartridge having such a developing device and an image forming apparatus having such a process cartridge.

In one embodiment, there is provided a developing device that includes: a toner carrying member having plural electrodes; a toner supply unit configured to supply the toner on a surface of the toner carrying member; and a hopping electric field generator unit configured to generate, when the toner is carried in a developing region facing a latent image carrying member, electric field for causing the toner to perform hopping on the surface of the toner carrying member by applying a pulse voltage to the plural electrodes carried thereon to attach the toner to the latent image on the latent image carrying member. In the developing device, the hopping electric field generator unit includes: a pulse voltage generator circuit configured to generate the pulse voltage; a first direct-current power source electrically disconnected from a ground and configured to supply bias for regulating a peak value of the pulse voltage to the pulse voltage generator circuit; and a second direct-current power source provided between a low level side of the first direct-current power source and the ground and having a polarity same as a charging polarity of the toner, and configured to output a variable voltage level. In developing device, the hopping electric field generator unit controls the peak value of the pulse voltage by changing an output level of the first power source, and controls a mean of the pulse voltage by changing an output level of the second power source.

In another embodiment, there is provided an image forming apparatus that includes: a developing device configured to supply a developer to a latent image formed on a latent image carrying member to obtain a developed image and finally transfer the developed image on a recording medium, In the image forming apparatus, the developing device includes: a toner carrying member having plural electrodes; a toner supply unit configured to supply the toner on a surface of the toner carrying member; and a hopping electric field generator unit configured to generate, when the toner is carried in a developing region facing the latent image carrying member, electric field for causing the toner to perform hopping on the surface of the toner carrying member by applying a pulse voltage to the plural electrodes carried thereon to attach the toner to the latent image on the latent image carrying member. In the image forming apparatus, the hopping electric field generator unit includes: a pulse voltage generator circuit configured to generate the pulse voltage; a first direct-current power source electrically disconnected from a ground and configured to supply bias for regulating a peak value of the pulse voltage to the pulse voltage generator circuit; and a second direct-current power source provided between a low level side of the first direct-current power source and the ground and having a polarity same as a charging polarity of the toner, and configured to output a variable voltage level. In the image forming apparatus, the hopping electric field generator unit controls the peak value of the pulse voltage by changing an output level of the first power source, and controls a mean of the pulse voltage by charging an output level of the second power source.

In another embodiment, there is provided a process cartridge that includes: a developing device; and at least one of an image carrying member, a charging device, and a cleaning device. The process cartridge detachably attached to an image forming apparatus. In the process cartridge, the developing device includes: a toner carrying member having plural electrodes; a toner supply unit configured to supply the toner on a surface of the toner carrying member; and a hopping electric field generator unit configured to generate, when the toner is carried in a developing region facing the latent image carrying member, electric field for causing the toner to perform hopping on the surface of the toner carrying member by applying a pulse voltage to the plural electrodes carried thereon to attach the toner to the latent image on the latent image carrying member. In the process cartridge, the hopping electric field generator unit includes: a pulse voltage generator circuit configured to generate the pulse voltage; a first direct-current power source electrically disconnected from a ground and configured to supply bias for regulating a peak value of the pulse voltage to the pulse voltage generator circuit; and a second direct-current power source provided between a low level side of the first direct-current power source and the ground and having a polarity same as a charging polarity of the toner, and configured to output a variable voltage level. In the process cartridge, the hopping electric field generator unit controls the peak value of the pulse voltage by changing an output level of the first power source, and controls a mean of the pulse voltage by changing an output level of the second power source.

DESCRIPTION OF THE PREFERRED EMBODIMENTS

Figure 2:
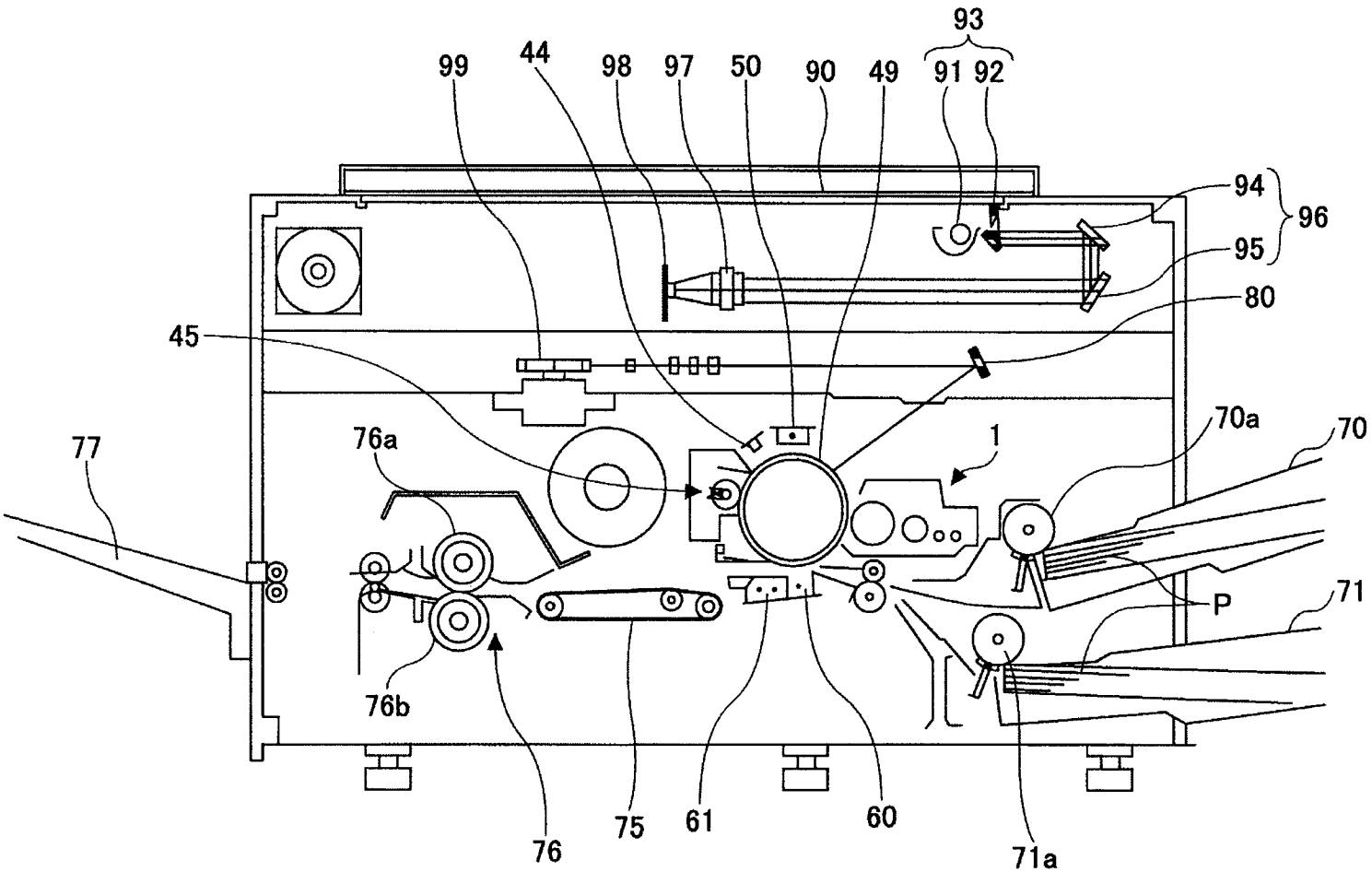
FIG. 2 is a schematic diagram illustrating a configuration of a copier according to an embodiment.

In the following, embodiments of the present invention will be described with reference to the accompanying drawings. FIG. 2 is a schematic diagram illustrating a configuration of a copier according to an embodiment. In FIG. 2, a photoreceptor drum 49 used as an image carrying member is rotationally driven in a clockwise direction. In the copier according to an embodiment, when a user places a document (not shown) on a contact glass 90 and presses a print start button (not shown), a document image is scanned while moving a first scanning optical system 93 having a document illuminating lamp 91 and a mirror 92 and a second optical system 96 having mirrors 94 and 95. The scanned document image are read as image signals by an image reading element 98 arranged behind the lens 97, the read image signals are converted into digital image signals, and the digital image signals are then image processed. Driven by the image processed signals, a laser diode (LD) emits a laser beam, and the emitted laser beam is reflected off a polygon mirror 99. The reflected laser beam then scans the photoreceptor drum 49 via a mirror 80. Prior to the scanning, the photoreceptor drum 49 is uniformly charged by a charging device 50, and electrostatic latent image is thus formed on a surface of the photoreceptor drum 49 by the laser scanning.

When developing processing is carried out by a developing device 1, toner is attached to the electrostatic latent image formed on the surface of the photoreceptor drum 49, and toner image is then formed on the surface of the photoreceptor drum 49. The toner image formed on the surface of the photoreceptor drum 49 is transferred, while the rotation of the photoreceptor drum 49, at a transferring position facing a position of a transfer charger 60. A recording paper P is fed to the transferring position from a first paper feeder 70 having a first paper feeding roller 70*a* or a second paper feeder 71 having a second paper feeding roller 71*a*. The toner image on the surface of the photoreceptor drum 49 is then transferred onto the recording paper P by corona discharge of the transfer charger 60.

The recording paper P having the transferred toner image on its surface is separated from the surface of the photoreceptor drum 49 by corona discharge of a separation charger 61, and the recording paper P separated from the surface of the photoreceptor drum 49 is then transferred to a fixing device 76 by a transfer belt 75. The recording paper P transferred in the fixing device 76 by a transfer belt 75 is nipped in a fixing nip formed by pressing a pressure roller 76*b* against a fixing roller 76*a* having a heat source such as a (not shown) halogen lamp. The toner image is then fixed on the surface of the recording paper P in the fixing nip by the application of pressure and heat, and the recording paper having the fixed toner image is then discharged onto a receiving tray 77.

In the copier according to the embodiment further includes a cleaning device 45 to remove a residual toner attached on the surface of the photoreceptor drum 49 that has passed the transferring position. Further, a static eliminating lamp 44 is provided to eliminate (neutralizes) static electricity of the cleaned surface of the photoreceptor drum 49 to prepare the photoreceptor drum 49 ready for a next electrostatic latent image formation.

In the copier according to the embodiment, the developing device 1, and at least one of the photoreceptor drum 49, the charging device 50 and the cleaning device 45 are integrated to form a process cartridge as one unit, and the process cartridge is detachably provided in a main body of the image forming apparatus. With this configuration, maintenance productivity of the developing device 1 or the like may be improved.

Figure 3:
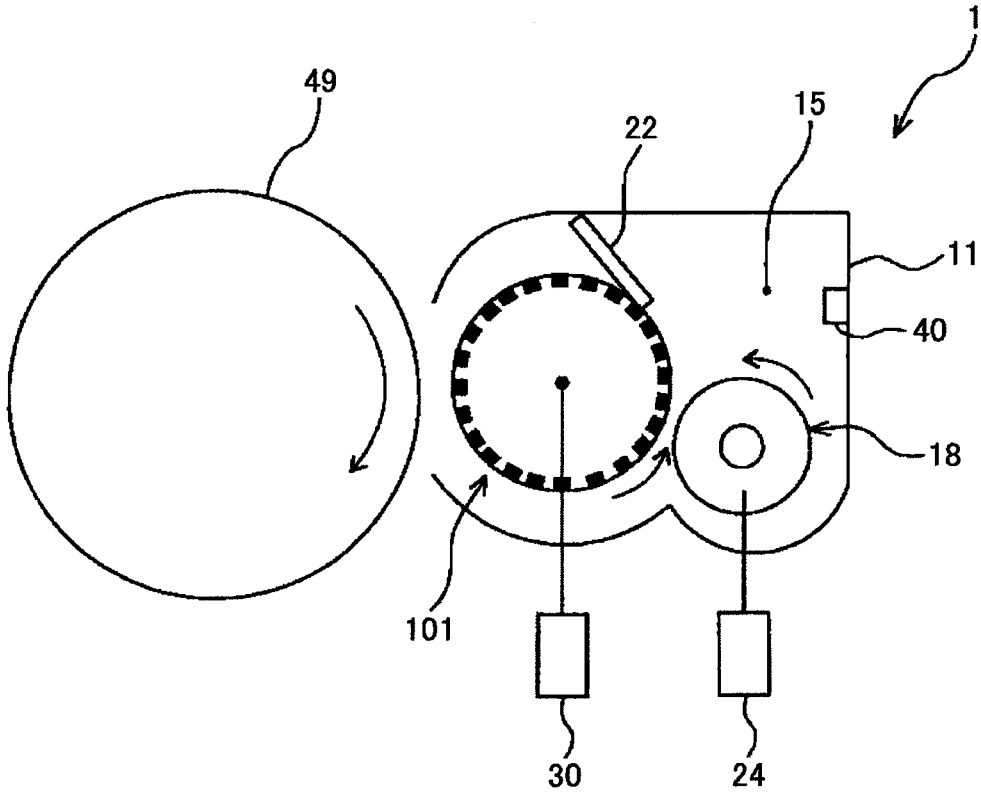
FIG. 3 is a schematic diagram illustrating a photoreceptor drum and a developing device in the copier according to the embodiment.

FIG. 3 is a schematic diagram illustrating the photoreceptor drum 49 and a developing device 1 in the copier according to the embodiment. In FIG. 3, the photoreceptor drum 49 is rotationally driven by a (not shown) drive unit in a clockwise direction. As illustrated in FIG. 3, the developing device 1 having a toner carrying roller 101 used as a developer carrying member is arranged on the right hand side of the photoreceptor drum 49.

The developing device 1 includes a toner supply roller 18 and a toner friction blade 22 in addition to the toner carrying roller 101. The toner supply roller 18 having a roller surface formed of sponge is rotationally driven by a (not shown) drive unit in a counterclockwise direction such that toner stored in the developing device 1 is carried on the roller surface of the toner supply roller 18. In FIG. 3, an example of a rotational direction of the toner supply roller 18 is illustrated. In this example, the toner supply roller 18 rotates in an opposite surface rotational direction to the surface rotational direction of the toner carrying roller 101 at a position where the toner carrying roller and the toner supply roller 18 mutually face. However, the rotational direction of the toner supply roller 18 may not be the opposite surface rotational direction to the surface rotational direction of the toner carrying roller 101. The rotational direction of the toner supply roller 18 may be set in the same direction as the surface rotational direction of the toner carrying roller 101.

The toner supply roller 18 includes a metallic rotational shaft member to which a supply bias is applied by a supply bias power source 24. The toner carrying roller 101 includes later described plural A-phase electrodes and plural B-phase electrodes to each of which a pulse voltage is repeatedly applied by a pulse voltage application unit 30. The mean of the applied pulse voltage has a higher value than the value of the supply bias in a reversed polarity direction of the toner charging polarity. Accordingly, electric field is generated between the toner supply roller 18 and the toner carrying roller 101 to electrostatically move the toner from the toner supply roller 18 to the toner carrying roller 101.

The toner carried on the surface of the toner supply roller 18 is supplied on the surface of the toner carrying roller 101 at a contact position where the toner supply roller 18 is brought into contact with the toner carrying roller 101. In this process, the amount of toner supplied may be adjusted based on the amount of the supply bias applied. Note that the supply bias may be any of a direct voltage, an alternating voltage, and a bias obtained by superimposing the alternating voltage onto the direct voltage.

The toner supplied on the surface of the toner carrying roller 101 rotationally travels in the counterclockwise direction due to a later described factor while performing hopping behaviors. A free end of the cantilever toner friction blade 22 abuts on a portion of the surface of the toner carrying roller 101, which is a region where the portion of the surface of the toner carrying roller 101 has passed the contact position with the toner supply roller 18 before reaching a developing region located opposite to the photoreceptor drum 49. When the toner that moves while hopping on the surface of the toner carrying roller 101 in the counterclockwise direction with the rotation of the toner carrying roller 101 is introduced between the toner carrying roller 101 and the toner friction blade 22, the toner is attached on the surfaces of the toner carrying roller 101 and the toner friction blade 22 while the surface of the toner carrying roller 101 is rubbed with the toner friction blade 22. This facilitates generation of friction charge. When the portion of the surface of the toner carrying roller 101 passes through the contact position of the toner carrying roller 101 with the toner friction blade 22 by the rotation of the toner carrying roller 101, the toner hopping on the surface of the toner carrying roller 101 is transferred in the developing region.

Meanwhile, a portion of an outer peripheral surface of the toner carrying roller 101 is exposed from an opening of a casing 11 of the developing device 1. The exposed portion of the toner carrying roller 101 faces the photoreceptor drum 49 via a gap width of several tens to several hundreds μm. Thus, the developing region of the copier according to the embodiment is formed at a position where the exposed portion of the toner carrying roller 101 faces the photoreceptor drum 49 via the gap. The toner hopping on the surface of the toner carrying roller 101 transferred to the developing region is attached to a electrostatic latent portion on the surface of the photoreceptor drum 49 by development field generated between the toner carrying roller 101 and the electrostatic latent image on the photoreceptor drum 49, thereby carrying out the development. The toner that is not used for the development is further transferred while hopping by the rotation of the toner carrying roller 101 in order to be used for the next development.

Note that the toner friction blade 22 may abut on the surface of the toner supply roller 18, instead of the toner carrying roller 101, to induce toner friction charge on the surface of the toner supply roller 18.

Figure 4A:
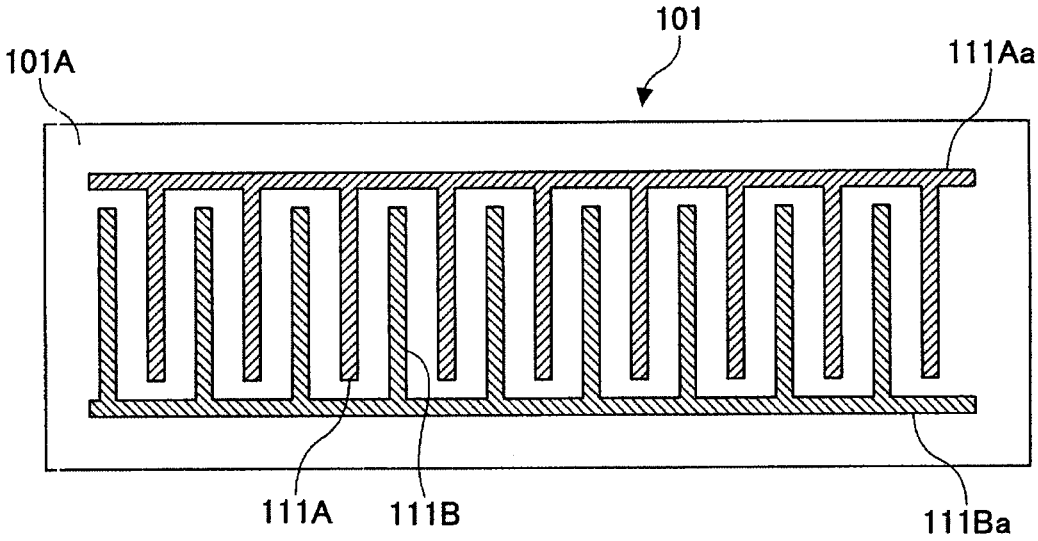
FIG. 4A is a schematic plan diagram illustrating a state in which a toner carrying roller is rolled out.
Figure 4B:
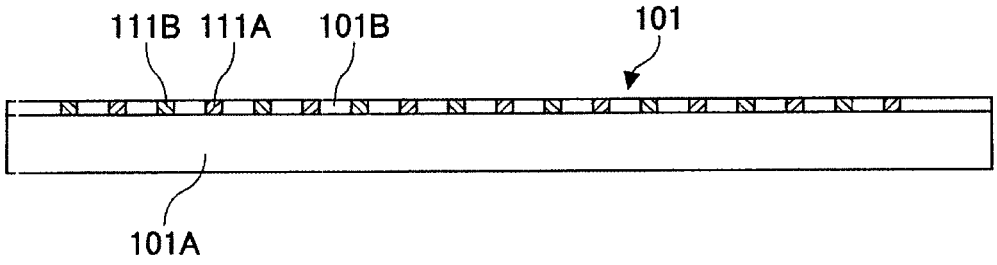
FIG. 4B is a schematic sectional diagram illustrating the toner carrying roller.

Next, an example of the toner carrying roller 101 is described with reference to FIG. 4. FIG. 4A is a schematic plan diagram illustrating a state in which the toner carrying roller 101 is rolled out, and FIG. 4B is a schematic sectional diagram illustrating the toner carrying roller 101.

Figure 5:
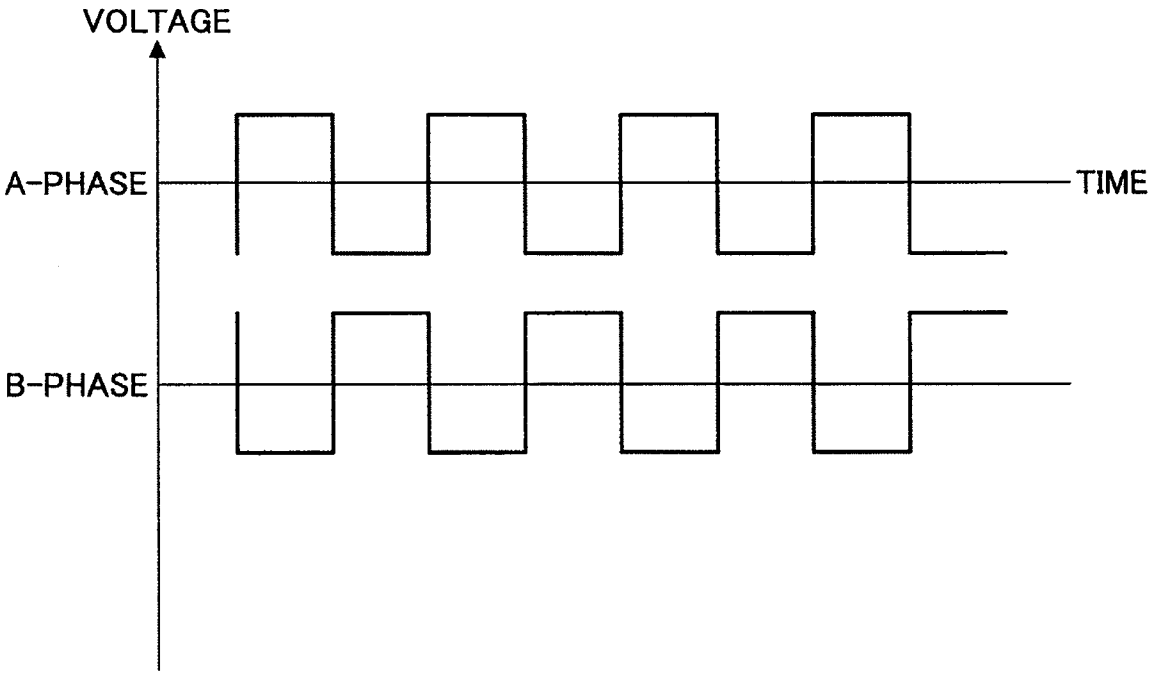
FIG. 5 is a graph illustrating an example of A-phase voltage applied to A-phase electrode and an example of B-phase voltage applied to B-phase electrode.

In this example of the toner carrying roller 101, two-phase electrodes are provided on the surface of the toner carrying roller 101. In the two phase electrodes, every other electrodes share the same phase. As illustrated in FIG. 5, two phase pulses having a phase difference of 180 degrees are applied to the toner carrying roller 101 to generate two-phase field where adjacent electrodes repeat attraction and repulsion.

The toner carrying roller 101 includes an insulator substrate 101A, an A-phase electrode 111A composed of plural electrodes 111 arranged on the surface of the insulator substrate 101A, a B-phase electrode 111B composed of plural electrodes arranged on the surface of the insulator substrate 101A, and a surface protection layer 101B to cover the insulator substrate 101A, the A-phase electrode 111A, and the B-phase electrode 111B. The A-phase electrode 111A and the B-phase electrode 111B have comb-like structures such that the electrodes of the A-phase electrode 111A and the B-phase electrode 111B are arranged in parallel at a fine pitch in directions perpendicular to a toner transferring direction, and a bus line 111Aa shared between the electrodes of the A-phase electrode 111A is provided at one side and a bus line 111Ba shared between the electrodes of the B-phase electrode 111B is provided at the other side. The bus lines 111Aa and 111Ba are connected to a (not shown) two-phase pulse output circuit that is externally provided.

The pulse voltage applied to the A-phase electrode 111A and the B-phase electrode 111B have a frequency of 0.3 kHz to 2 kHz, and include a DC bias voltage. However, the pulse voltage applied to the A-phase electrode 111A and the B-phase electrode 111B have a peak value of 300 to 600 V, and thus the pulse voltage applied to the A-phase electrode 111A and the B-phase electrode 111B vary with a width of the electrode and an inter-electrode gap. In a case of generating the two-phase field, the toner reciprocally moves between the adjacent A-phase electrode and B-phase electrode while repeating attraction toner hopping and repulsion toner hopping by switching directions of the electric field generated between the adjacent A-phase electrode and B-phase electrode.

Next, voltages applied to the A-phase electrode 111A and the B-phase electrode 111B are described. An A-phase voltage and a B-phase voltage generated from the pulse voltage application unit 30 are respectively applied to the A-phase electrode 111A and the B-phase electrode 111B on the toner carrying roller 101. It is preferable that the A-phase voltage and the B-phase voltage applied by pulse voltage application unit 30 each have a rectangular wave. In the copier according to the embodiment, a two-phase configuration having the A-phase electrode 111A and the B-phase electrode 111B is employed for forming a cloud forming electrode, so that the voltages mutually having a phase difference 11 are respectively applied to the A-phase electrode 111A and the B-phase electrode 111B.

FIG. 5 is a graph illustrating an example of the A-phase voltage applied to the A-phase electrode and an example of the B-phase voltage applied to the B-phase electrode. In the copier according to the embodiment, the A-phase voltage applied to the A-phase electrode 111A and the B-phase voltage applied to the B-phase electrode 111B each have a rectangular wave. The A-phase voltage and the B-phase voltage have the same voltage (i.e., the same peak-to-peak voltage Vpp) and mutually have a phase difference π (e.g., B-phase voltage has a phase difference π from A-phase voltage). Thus, a potential difference Vpp is constantly generated between the A-phase electrode 111A and the B-phase electrode 111B. The electric field is generated based bon the potential difference Vpp, and a cloud forming field of the generated electric field formed outside of a surface layer of the toner carrying roller 101 causes the toner to perform hopping behaviors on the surface layer of the toner carrying roller 101.

Thus, a toner cloud forming unit (not shown) includes plural electrodes extending on the surface of the toner carrying roller 101 in directions perpendicular to the toner transferring direction arranged at predetermined intervals. The toner cloud forming unit is configured such that the voltages are applied to the corresponding electrodes to cause the toner reciprocally moves between the adjacent electrodes while repeating repulsion and attraction movements between the adjacent electrodes. Accordingly, the toner forms a cloud configuration while the toner carrying roller 101 is rotationally moved. As a result, the toner is stably transferred on the surface of the toner carrying roller 101 without affecting toner charging quality, and a highly reliable copier may be obtained.

Figure 6A:
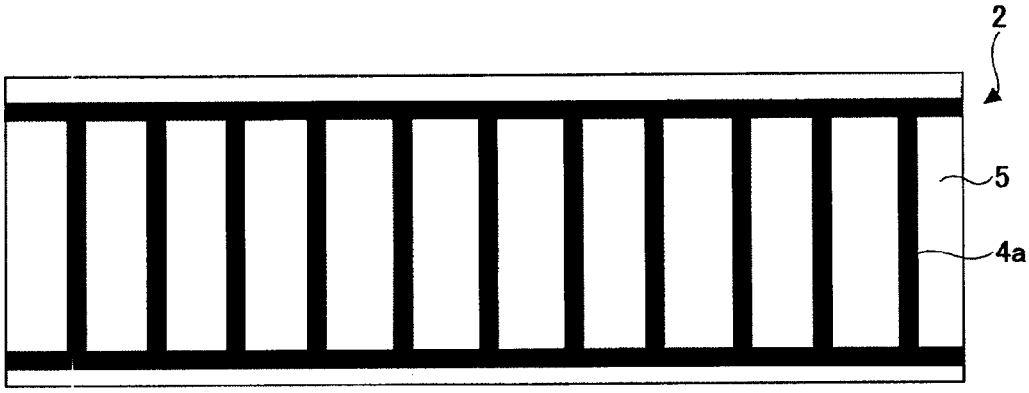
FIG. 6A is a schematic plan diagram illustrating a state in which a toner carrying roller is rolled out.
Figure 6B:
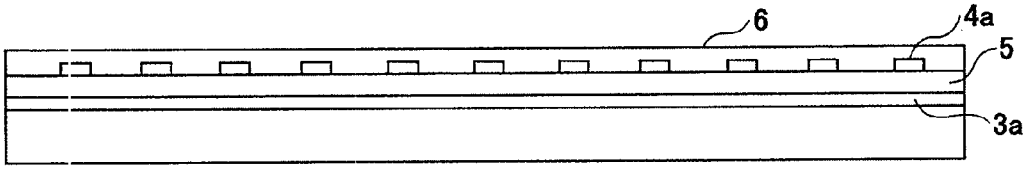
FIG. 6B is a schematic sectional diagram illustrating the toner carrying roller.

Next, another example of a toner carrying roller 2 used in the developing device 1 according to the embodiment is described with reference to FIGS. 6A and 6B. Note that FIG. 6A is a schematic plan diagram illustrating a state in which the toner carrying roller 2 is rolled out, and FIG. 6B is a schematic sectional diagram illustrating the toner carrying roller 2.

In this example, plural electrodes are provided on a surface layer of the toner carrying roller 2, and a conductive substrate electrode 3*a* is provided on a lower layer via an insulator layer. The two phase pulses (see FIG. 5) having a phase difference of 180 degrees are applied to the toner carrying roller 2 to generate two-phase field where the surface layer electrodes and the conductive substrate electrode provided on the lower layer repeat attraction and repulsion.

The toner carrying roller 2 according to the embodiment includes a hollow roller member, an inner electrode 3*a* employed as an innermost electrode member or an inner electrode member located at an innermost periphery of the toner carrying roller 2, and an outer electrode 4*a* employed as an outermost electrode member or an outer electrode member located at an outermost periphery of the toner carrying roller 2. The outer electrode 4*a* is applied with the voltage (outer voltage) differing from the voltage (inner voltage) applied to the inner electrode 3*a*. An insulator layer 5 is arranged between the inner electrode 3*a* and the outer electrode 4*a* to insulate between them. A surface layer 6 is provided as a protection layer such that the surface layer 6 covers the outer periphery of the outer electrode 4*a*. That is, the toner carrying roller 2 of the copier according to the embodiment includes a four-layer structure, where the inner electrode 3*a*, the insulator layer 5, the outer electrode 4*a*, and the surface layer 6 are arranged in this order from the innermost peripheral side.

The inner electrode 3*a* is a metallic roller obtained by molding a conductive material such as stainless steel (SUS) or aluminum into a cylindrical tube, which is configured to function as a substrate (base) of the toner carrying roller 2. The inner electrode 3*a* may also be a resin roller made of polyacetal (POM) or polycarbonate (PC) on a surface of which a conductive layer such as a metallic layer made of aluminum or copper is formed. The conductive layer may be formed by metallic plating, vapor deposition, or by attaching a metallic film to the roller surface.

The outer peripheral side of the inner electrode 3*a* is covered with the insulator layer 5. The insulator layer 5 used in the copier according to embodiment is made of polycarbonate or alkyd melamine. The insulator layer 5 is formed on the inner electrode 3*a* with a uniform film thickness by spraying or dipping.

The outer electrode 4*a* is formed on the insulator layer 5. The outer electrode 4*a* used in the copier according to Embodiment is made of metal such as aluminum, copper, polycarbonate or silver. The outer electrode 4*a* may be formed by various methods. One exemplified method includes initially forming a metallic film on the insulator layer 5 by vapor deposition, and the obtained metallic film is then processed by photoresist etching to form the outer electrode 4*a* on the insulator layer 5. An alternative exemplified method includes attaching conductive paste on the insulator layer 5 by inkjet or screen printing to form comb-like outer electrode 4*a* on the insulator layer 5.

The outer peripheral surfaces of the outer electrode 3*a* and the insulator layer 5 are covered with the surface layer 6. The surface layer 6 may be made of silicone, nylon (registered trademark), urethane, alkyd melamine, and polycarbonate. The surface layer 6 may be formed by spraying or dipping in a similar manner as the formation of the insulator layer 5.

In this embodiment, the electric field formed between the inner electrode 3*a* and the outer electrode 4*a* is formed outside of the surface layer 6, so that the electric field formed outside of the surface of layer 6 causes the toner to perform hopping on the surface of the toner carrying roller 2 to thereby form a toner cloud. More specifically, the electric field formed at portions where the inner electrode 3*a* does not face the outer electrode 4*a* is formed outside the surface layer 6 to cause the toner to perform hopping and form a toner cloud. In this process, the toner reciprocally moves while performing hopping between portions of the surface layer 6 facing the inner electrode 3*a* via the insulator layer 5 and their adjacent portions of the surface layer 6 facing the outer electrode 4*a*.

Next, voltages applied to the inner electrode 3*a* and the outer electrode 4*a* are described. An inner voltage and an outer voltage generated from the pulse voltage application unit 30 are respectively applied to the inner electrode 3*a* and the outer electrode 4*a* on the toner carrying roller 2. The outer electrode 4*a* has a corn-like structure and elongated portions of the outer electrode 4*a* are arranged in parallel at a fine pitch in directions perpendicular to a toner transferring direction, and power supplied portions are formed on both sides of the outer electrode 4*a*. The power supplied portions formed at the both sides of the outer electrode 4*a* are each connected to a (not shown) pulse voltage application unit 30 that is externally provided. It is preferable that the inner voltage and the outer voltage applied by the pulse voltage application unit 30 have a rectangular wave. In the copier according to the embodiment, a two-phase configuration having the inner electrode 3*a* and the outer electrode 4*a* is employed for forming a cloud forming electrode, so that the voltages mutually having a phase difference $\pi$ are respectively applied to the inner electrode 3*a* and the outer electrode 4*a*.

Figure 7:
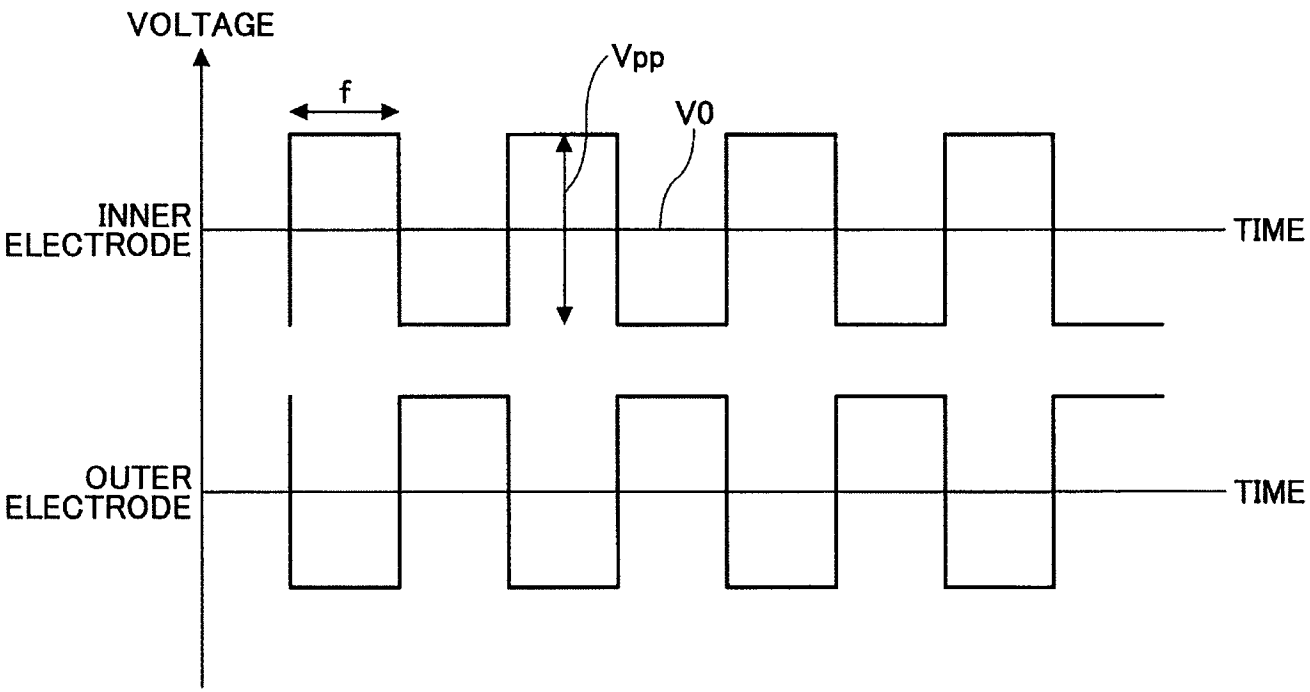
FIG. 7 is a graph illustrating an example of an inner voltage applied to an inner electrode and an example of an outer voltage applied to an outer electrode.

FIG. 7 is a graph illustrating an example of an inner voltage applied to an inner electrode and an example of an outer voltage applied to an outer electrode. In the copier according to the embodiment, the inner voltage applied to the inner electrode 3*a* and the outer voltage applied to the outer electrode 4*a* each have a rectangular wave. The inner voltage and the outer voltage have the same voltage (i.e., the same peak-to-peak voltage Vpp) and mutually have a phase difference $\pi$ (e.g., outer voltage has a phase difference $\pi$ from inner voltage). Thus, a potential difference Vpp is constantly generated between the inner electrode 3*a* and the outer electrode 4*a*. The electric field is generated based on the potential difference Vpp, and a cloud forming field of the generated electric field formed outside of the surface layer 6 of the toner carrying roller 2 causes the toner to perform hopping behaviors on the surface layer 6 of the toner carrying roller 2.

The pulse voltage applied to the inner electrode 3*a* and the outer electrode 4*a* have a frequency of 0.3 kHz to 2 kHz, and include a DC bias voltage. However, the pulse voltage applied to the inner electrode 3*a* and the outer electrode 4*a* have a peak value of 300 to 600 V, which vary with a width of the electrode and an inter-electrode gap. In this embodiment, the electric field formed between the inner electrode 3*a* and the outer electrode 4*a* is formed outside of the surface layer 6, so that the electric field formed outside of the surface of layer 6 causes the toner to perform hopping on the surface of the toner carrying roller 2 to thereby form a toner cloud. More specifically, the electric field formed at portions where the inner electrode 3*a* does not face the outer electrode 4*a* is formed outside the surface layer 6 to cause the toner to perform hopping and form a toner cloud. In this process, the toner reciprocally moves while performing hopping between portions of the surface layer 6 facing the inner electrode 3*a* via the insulator layer 5 and their adjacent portions of the surface layer 6 facing the outer electrode 4*a*. Note that the entire toner carrying roller 2 rotates in a toner transferring direction.

Figure 20:
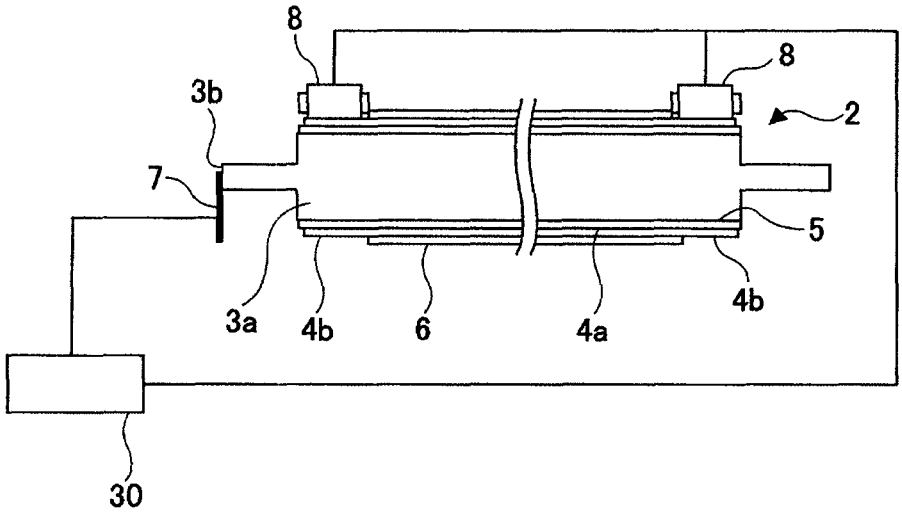
FIG. 20 is a schematic sectional diagram illustrating a power supply configuration for supplying power to the inner electrode and the outer electrode sectioned along a roller shaft of the toner carrying member.
Figure 21:
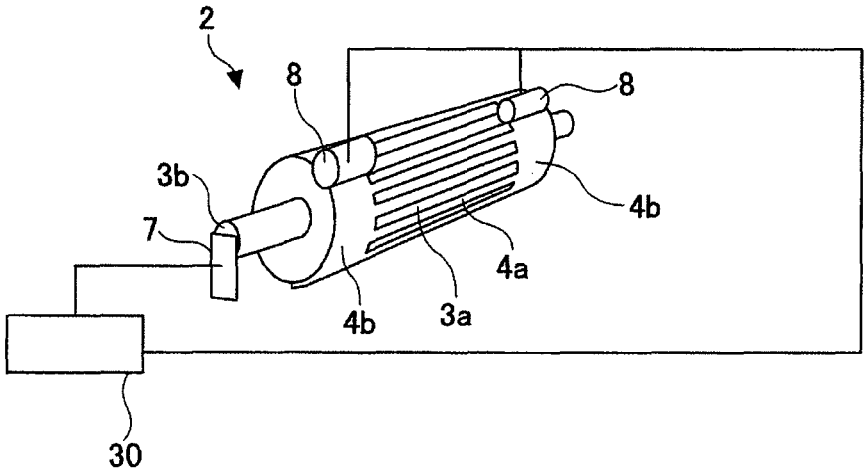
FIG. 21 is a schematic perspective diagram illustrating the power supply configuration for supplying power to the inner electrode and the outer electrode in FIG. 20.

FIG. 20 is a schematic sectional diagram illustrating a power supply configuration for supplying power to the inner electrode 3*a* and the outer electrode 4*a* sectioned along a roller shaft of the toner carrying member. FIG. 21 is a schematic perspective diagram illustrating the power supply configuration for supplying power to the inner electrode 3*a* and the outer electrode 4*a* in FIG. 20. In the power supply configuration for supplying power to inner electrode 3*a* and the outer electrode 4*a* of the copier according to the embodiment, the inner electrode 3*a* is integrated with a roller shaft of the toner carrying roller 2, and an end face of the roller shaft is used as a power supplied portion 3*b*. The power supplied portion 3*b* formed of the end face of the roller shaft is in contact with a power supply brush 7 (i.e., a first power supply member) connected to the pulse voltage application unit 30. Meanwhile, the surface layer 6 is not provided on both end portions of the outer periphery of the toner carrying roller 2. That is, both end portions of the outer periphery of the toner carrying roller 2 adjacent to a region where the outer electrode 4*a* is formed are exposed, and the exposed end portions are used as power supplied portions 4*b*. The power supplied portions 4*b* formed of the exposed end portions of the outer periphery of the toner carrying roller 2 are in contact with power supply rollers 8 (i.e., second power supply members) connected to the pulse voltage application unit 30. The power supply rollers 8 are rotationally supported on the toner carrying roller 2 such that the power supply rollers 8 are rotated in coordination with the rotation of the toner carrying roller 2 while being in contact with the power supplied portions 4*b*.

Note that the copier according to the embodiment is provided with two power supply rollers 8 as the second power supply members for applying the outer voltage to the outer electrode 4*a*; however, the number of the power supply rollers may be one or three or more. If the number of the second power supply members for applying the outer voltage to the outer electrode 4*a* is two or more, the power is stably supplied to the outer electrode 4*a*. That is, even if one of the second power supply members supplies insufficient power to the outer electrode 4*a* due to poor contact, the other one is capable of supplying power to the outer electrode 4*a*. Thus, the power is stably supplied to the outer electrode 4*a* with such a configuration.

Further, as described above, the copier according to the embodiment has a power system in which two end portions of the outer periphery of the toner carrying roller 2 adjacent to a region where the outer electrode 4*a* is formed are exposed, and the exposed end portions are used as the power supplied portions 4*b* that are in contact with the second power supply members. In this case, it is preferable that the power supplied portions 4*b* be placed in outward directions from a developing width in the surface of the toner carrying roller 2. Note that the developing width may face a region of the photoreceptor drum 49 where an electrostatic latent image is formed. That is, if the power supplied portions 4*b* are located within the developing width, the toner (i.e., toner particles) is flattened between the toner carrying roller 2 and the power supplied portions 4*b*, and thus the flattened toner is used for the development, thereby causing the development degradation. Accordingly, it is more preferable that the power supplied portions 4*b* be placed outside of a toner supply width of the surface of the toner carrying roller 2 in a roller shaft direction. Note that the toner supply width is a region where toner is supplied from the toner supply roller 18. That is, if the power supplied portions 4*b* are located within the toner supply width, a large amount of toner may be supplied between the toner carrying roller 2 and the power supplied portions 4*b*, which causes power supply defect. Thus, in the copier according to the embodiment, the power supplied portions 4*b* are placed outside of the toner supply width of the toner carrying roller 2 in the roller shaft direction. Further, in the copier according to the embodiment, a toner seal (not shown) is provided in a central portion sandwiched between the power supplied portions 4*b* corresponding to both end portions of the toner carrying roller 2 such that the toner within the toner supply width is not attached to the power supplied portions 4*b*.

Note that in the copier according to the embodiment, the power supply roller 8 rotated in coordination with the rotation of the power supplied portions 4*b* are provided as the second power supply members; however, the second power supply members are not limited to the power supply roller 8. For example, conductive brushes or conductive blade springs may also be used as the second power supply members in place of the power supply roller 8. Note that if the conductive brushes or the conductive blade springs configured to slide on the power supplied portions 4*b* are used as the second power supply members, conductive grease may be applied to a contact portion between the second power supply members and the power supplied portions 4*b* to suppress abrasion. Further, in the copier according to the embodiment, the end face of the roller shaft is used as the power supplied portion 3*b* for the inner electrode 3*a*; however, the power supplied portion 3*b* may not be limited to the end face of the roller shaft. For example, a peripheral surface of the roller shaft or an end face of the roller main body may also be used as the power supplied portion 3*b* for the inner electrode 3*a* in place of the end face of the roller shaft.

Figure 1:
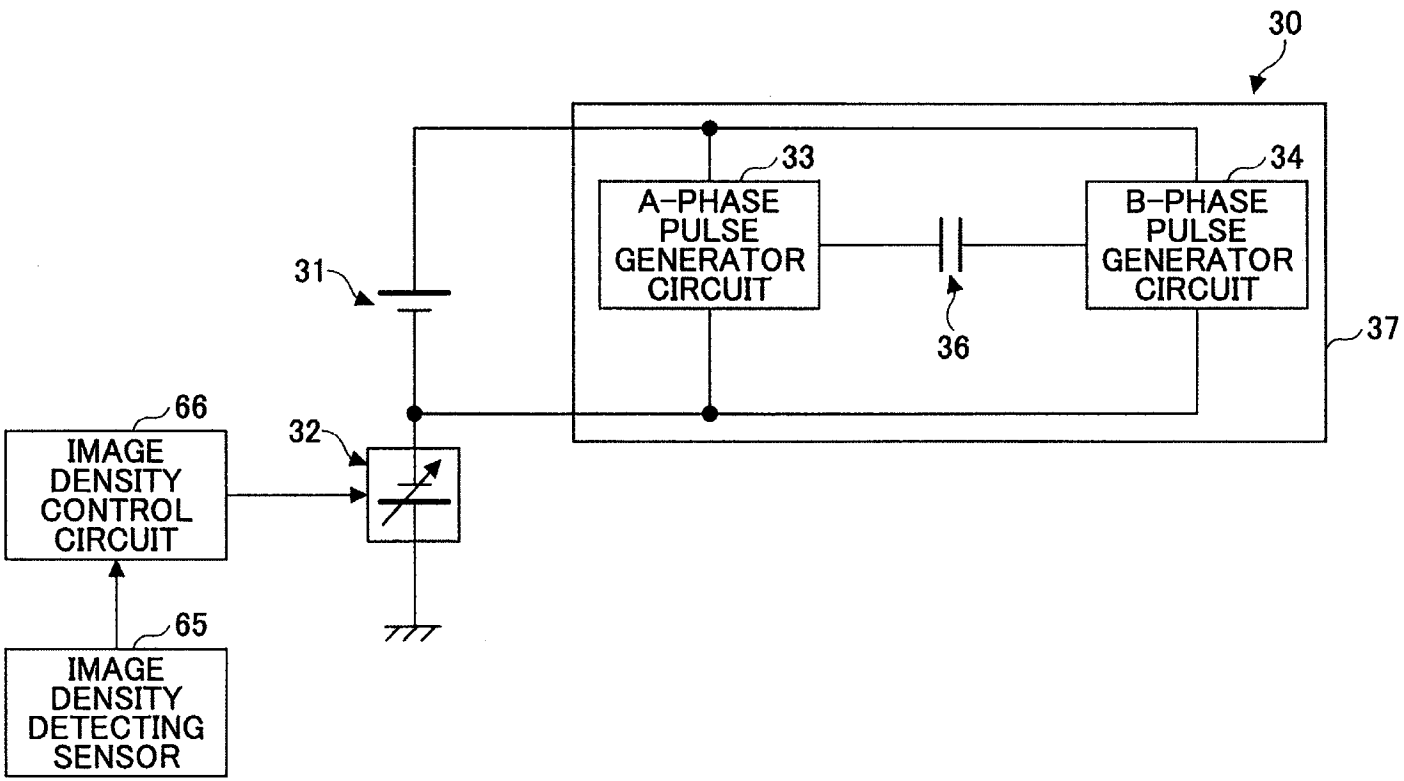
FIG. 1 is a schematic diagram illustrating a configuration of a cloud pulse generator circuit when negatively charged toner is used.

FIG. 1 illustrates a configuration of the pulse voltage application unit 30. As illustrated in FIG. 1, the pulse voltage application unit 30 includes a power source 31 that is used for outputting a cloud pulse and is configured to have mutually isolated primary and secondary circuits, where a primary circuit electrically isolated from a secondary circuit. That is, the secondary circuit is a floating ground circuit. The pulse voltage application unit 30 further includes a power source 32 that is used for outputting a minus DC bias and is configured to have a primary circuit and a secondary circuit both connected to a common ground GND. The pulse voltage application unit 30 still further includes a two-phase output circuit 37 having an A-phase pulse generator circuit 33 to generate an A-phase pulse and a B-phase pulse generator circuit 34 to generate a B-phase pulse.

Figure 8:
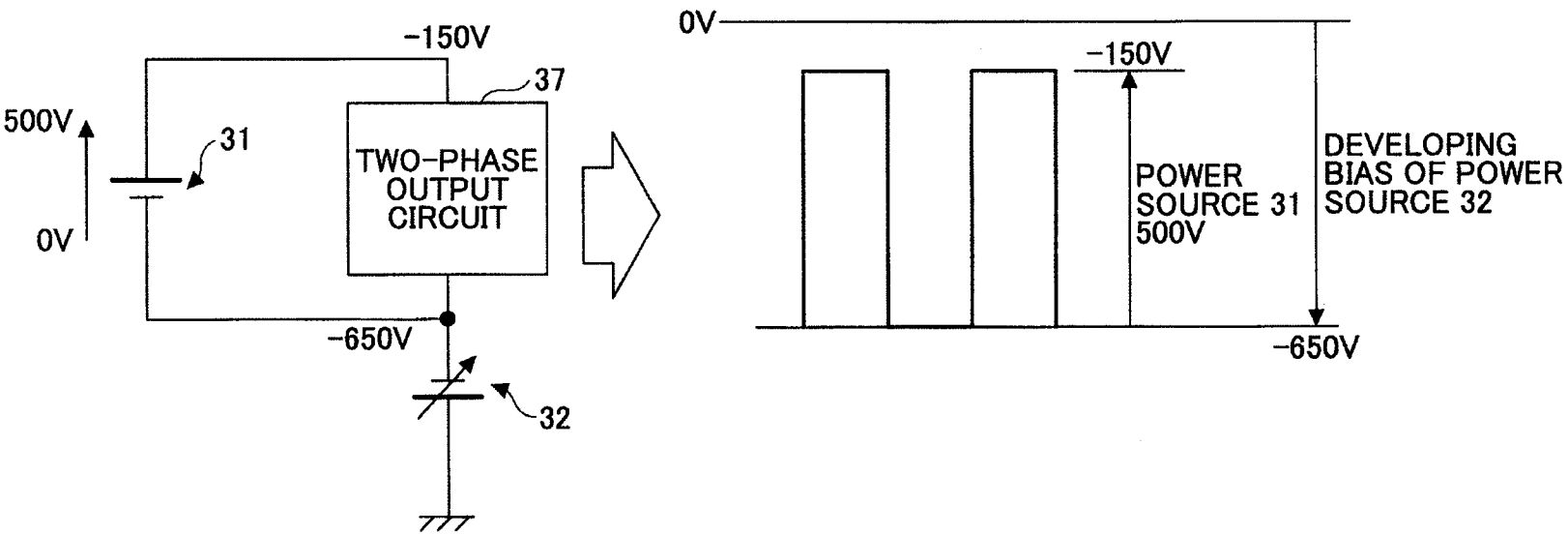
FIG. 8 is a schematic diagram illustrating a configuration of the cloud pulse generator circuit when negatively charged toner is used illustrated in FIG. 1, and an example of its waveform diagram.

For example, if the output of the power source 31 is 500 V, a high level side of the power source 31 is connected to corresponding upper sides of the A-phase pulse generator circuit 33 and the B-phase pulse generator circuit 34, and a low Level side of the power source 31 is connected to lower sides of the A-phase pulse generator circuit 33 and the B-phase pulse generator circuit 34, and to a minus high level side of the power source 32. When negatively charged toner is used for the development, the development bias of the power source 32 has a minus potential. For example, if the development bias of the power source 32 is −650 V, the low level side of the power source 31 has a minus potential of −650 V. Accordingly, a pulse wave generated in each of the pulse generator circuits applied with 500 V from the power source 31 forms a cloud pulse having a peak value of −650 V to −150 V (see FIG. 8).

In this process, image density is controlled and made uniform as follows. That is, the pulse voltage application unit 30 employs a DC power source for outputting a variable DC output level as the power source 32, an image density detecting sensor 65 for detecting image density of a test pattern developed on the photoreceptor drum 49, an image density control circuit 66 for determining whether the image density satisfies a standard level. If the image density is lower than the standard level, the image density control circuit 66 raises the DC output level of the power source 32 to a minus direction to increase the development bias to the latent image potential, thereby making the image intensity uniform. If, on the other hand, the image density is higher than the standard level, the image density control circuit 66 lowers the DC output level of the power source 32 to the minus direction to decrease the development bias to the latent image potential, thereby making the image intensity uniform (see FIG. 10).

Figure 9:
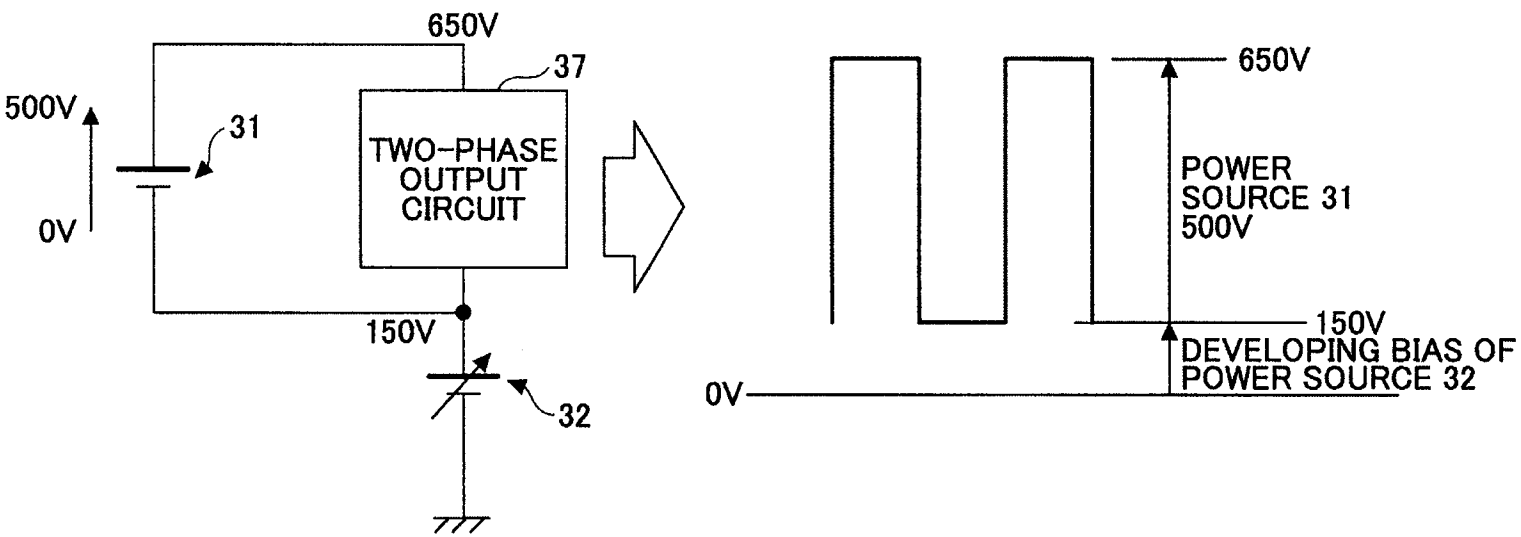
FIG. 9 is a schematic diagram illustrating a configuration of a cloud pulse generator circuit when positively charged toner is used and an example of its waveform diagram.

FIG. 9 illustrates a configuration of the pulse voltage application unit 30 when positively charged toner is used. Referring to FIG. 9, the pulse voltage application unit 30 (not shown) includes a power source 31 that is used for outputting a cloud pulse and is configured to have mutually isolated primary and secondary circuits, where a primary circuit electrically isolated from a secondary circuit. That is, the secondary circuit is a floating ground circuit. The pulse voltage application unit 30 further includes a power source 32 that is used for outputting a plus DC bias and is configured to have a primary circuit and a secondary circuit both connected to a common ground GND.

For example, if the output of the power source 31 is 500 V, a high level side of the power source 31 is connected to upper sides of the A-phase pulse generator circuit 33 and the B-phase pulse generator circuit 34, and a low level side of the power source 31 is connected to lower sides of the A-phase pulse generator circuit 33 and the B-phase pulse generator circuit 34, and to a minus high level side of the power source 32. When positively charged toner is used for the development, the development bias of the power source 32 has a plus potential. For example, if the development bias of the power source 32 is 150 V, the low level side of the power source 32 has a plus potential of 150 V. Accordingly, a pulse wave generated in each of the pulse generator circuits applied with 500 V from the power source 31 forms a cloud pulse having a peak value of 650 to 150 V.

Figure 10:
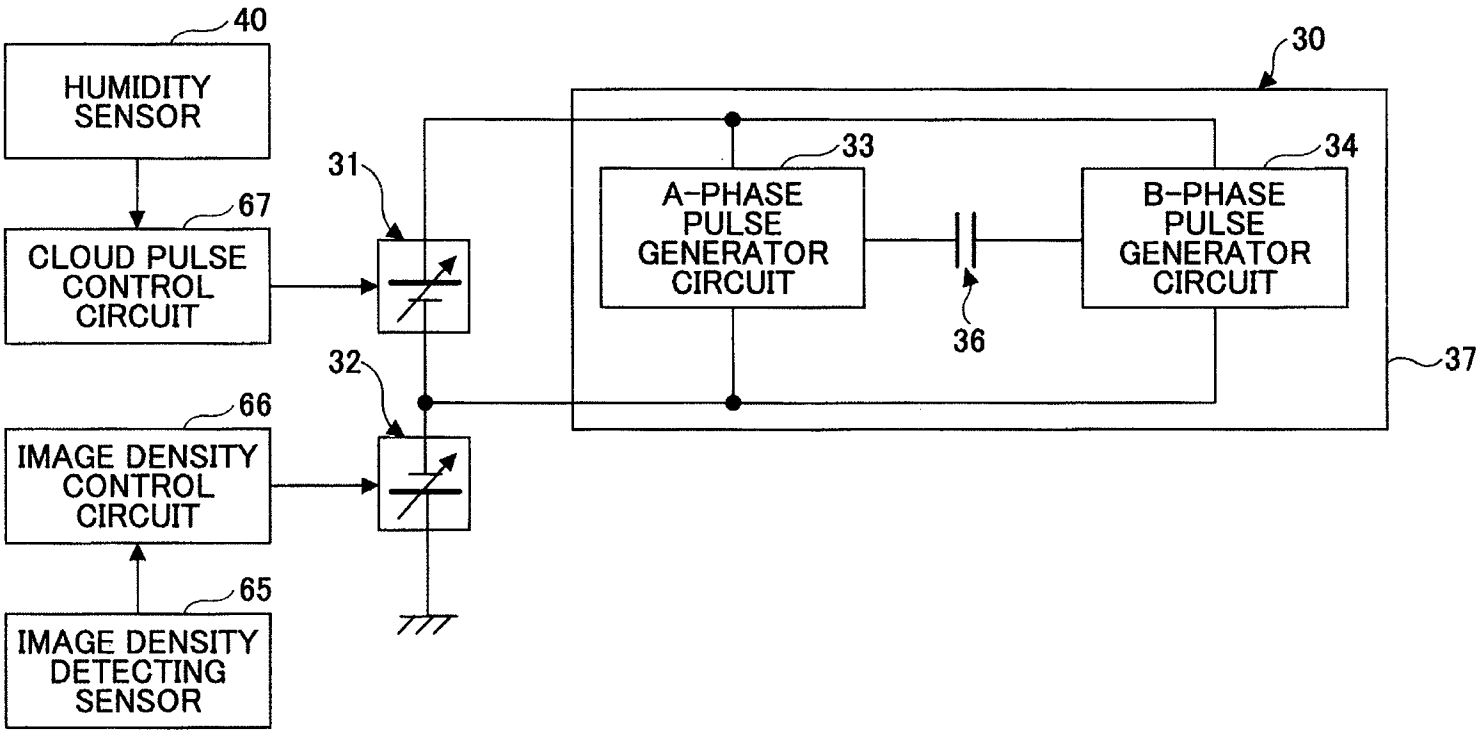
FIG. 10 is a schematic diagram illustrating a configuration of the cloud pulse generator circuit when the positively charged toner is used.

Next, FIG. 10 illustrates an example where the pulse voltage application unit 30 in FIG. 1 employs the power source 31 as a DC power source for outputting a variable DC output level to control the peak value of the cloud pulse. If the output of the power source 31 is changed, the cloud pulse is output based on the changed output level. However, if the output of the power source 32 is fixed, the peak value may be changed while the low potential side of the cloud pulse generator circuit is fixed. For example, under a high-humidity environment, the attraction of the toner to a surface of a toner transferring unit rises and the cloud amount of the toner is decreased, thereby lowering development efficiency. If the above adverse factors are controlled by the development bias of the power source 31 capable of outputting a variable DC output level, the difference between the development bias and a base surface potential of the photoreceptor drum 49 is decreased, thereby contaminating the base surface (non-mage forming region) of the photoreceptor drum 49 or reducing an allowable contamination range of the base surface of the photoreceptor drum 49. Accordingly, the pulse voltage application unit 30 may be provided with a humidity sensor 40. If the humidity sensor 40 detects high-humidity, the cloud pulse control circuit 67 corrects the decrease in the cloud amount of the toner by raising the output level of the power source 31 to raise the peak value of the cloud pulse. As a result, the image density degradation due to toner degradation or due to toner charge fluctuation may easily be controlled, and the development may be carried out with high quality and high reliability.

Figure 11:
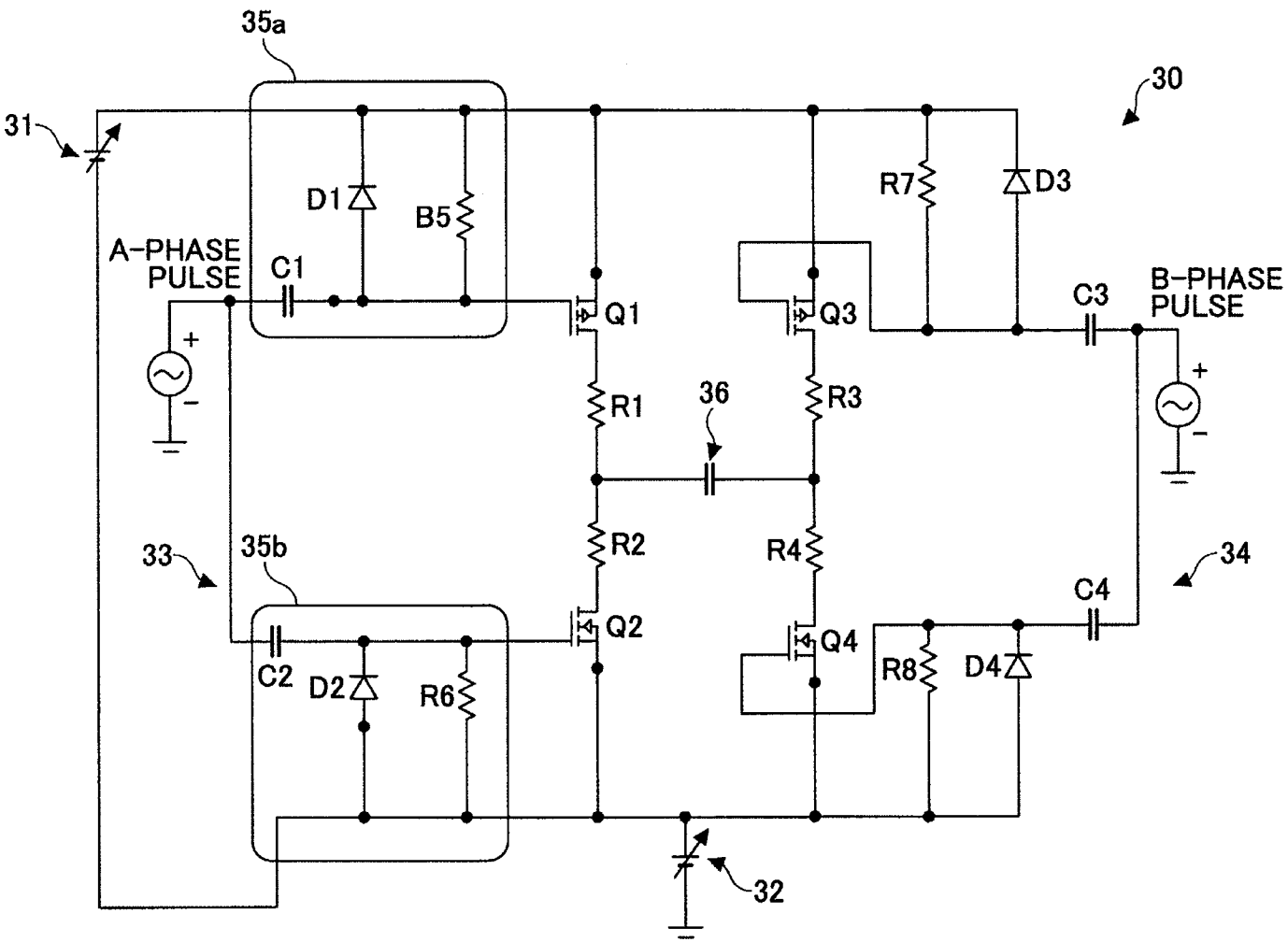
FIG. 11 is a circuit diagram illustrating the cloud pulse generator circuit to which a cloud pulse and a bias voltage are applied from corresponding power sources.

FIG. 11 illustrates a specific circuit example of the pulse voltage application unit 30. The pulse voltage application unit 30 includes two switching elements Q1 and Q2 formed of metal oxide semiconductor field effect transistors (MOSFETs) serially connected between terminals of the DC output power source 31, and current regulating resistors R1 and R2 are provided with the A-phase pulse generator circuit 33, two switching elements Q3 and Q4 formed of metal oxide semiconductor field effect transistors (MOSFETs) serially connected between terminals of the DC output power source 31, and current regulating resistors R3 and R4 are provided with the B-phase pulse generator circuit 34, an electrode load (electrode load capacity) 36 including a first group of electrodes of the toner carrying roller 101 connected between the two switching elements Q1 and Q2 (i.e., between current regulating resistors R1 and R2 in this example) and a second group of electrodes of the toner carrying roller 101 are connected between the two switching elements Q3 and Q4 (i.e., between current regulating resistors R3 and R4 in this example) is provided between the A-phase pulse generator circuit 33 and the B-phase pulse generator circuit 34 to form a bridge configuration. In the pulse voltage application unit 30 having such a configuration, a positive-phase cloud pulse (A-phase pulse in this embodiment) is applied by turning the switching elements Q1 and Q4 ON, and a negative (reversed)-phase cloud pulse (B-phase pulse in this embodiment) is applied by turning the switching elements Q2 and Q3 ON. Accordingly, the toner repeats hopping between the first electrode group and second electrode group to thereby form a toner cloud on the toner carrying roller surface.

Note that in the pulse voltage application unit 30 according to this embodiment, after a drive circuit for driving the MOFSETs generates a low pulse voltage of 15 V, a gate signal of the switching element Q1 applied with the low pulse voltage of 15V is clamped at the high level side of the power source 31 by a clamp circuit 35*a* including a capacitor C1, a diode D1 and a current regulating resistor R5 while the low pulse voltage of 15 V is at a high level. That is, if the voltage of the power source 31 is 500 V and the voltage of the power source 32 is −650 V, the gate signal of the switching element Q1 has a pulse voltage of −150 to −135 V so that the switching element Q1 is turned ON while the low pulse voltage of 15 V is at a low level.

Further, a gate signal of the switching element Q2 applied with the low pulse voltage of 15V is clamped at the low level side of the power source 31 by a clamp circuit 35*b* including a capacitor C2, a diode D2 and a current regulating resistor R6 while the low pulse voltage of 15 V is at a low level. That is, if the voltage of the power source 31 is 500 V and the voltage of the power source 32 is −650 V, the gate signal of the switching element Q2 has a pulse voltage of −650 to −635 V so that the switching element Q2 is turned ON while the low pulse voltage of 15 V is at a high level.

Similarly, the switching elements Q3 and Q4 at the B-phase side of the negative-phase operate with a phase delay of 180 degrees.

In this process, if the image forming operation is conducted under a high-humidity environment, adhesive force between the toner and the surface of the toner carrying roller may be increased due to an increase in liquid cross-linking force, or the electrostatic force generated by the alternating electric field acting on the toner may be decreased due to a decrease in a charging amount of the toner resulting from lowered toner charging efficiency. The adhesive force acting between the toner and the surface toner carrying roller may be increased by embedment or separation of additive agent due to deterioration of toner. Accordingly, the toner is inhibited from hopping on the toner carrying roller, causing a decrease in the amount of toner attached to a latent image portion formed on the surface of the photoreceptor drum 49, thereby lowering the image intensity. Thus, the electric field capable of causing the toner to perform excellent hopping is generated by controlling the peak value of the cloud pulse in order to overcome the adhesive force between the toner and the surface of the toner carrying roller.

Figure 12:
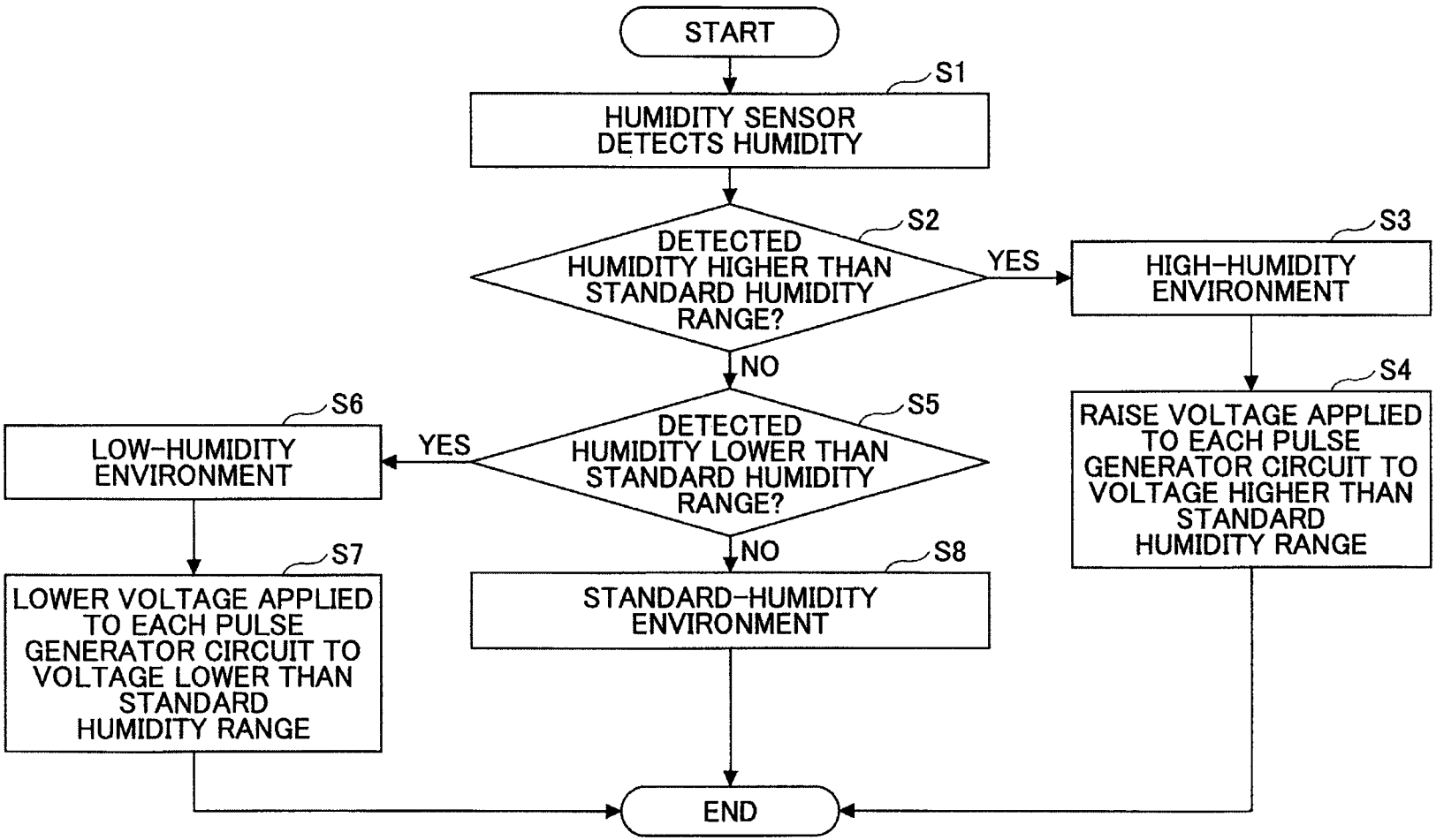
FIG. 12 is a flowchart illustrating an example of a control process carried out by the copier according to the embodiment.

FIG. 12 is a flowchart illustrating an example of a control process carried out by the copier according to the embodiment. For example, the control process includes detecting humidity of an environment (copier or developing device environment) by the humidity sensor 40 (see FIG. 10) provided inside the developing device (step S1), determining whether the detected humidity is higher than the initially set standard humidity range obtained under the standard-humidity environment (step S2), determining that the copier is under the high-humidity environment (step S3) if the detected humidity is higher than the standard humidity by a control unit including a CPU and a memory provided inside the copier main body or the developing device (YES in Step S2), and raising the peak value of the pulse voltage output by the power source 31 from 500 to 600 based on a control signal received from the control unit (step S4). If the DC bias voltage of the power source 32 is −650 V in the same manner as the bias voltage under the standard-humidity environment, the peak value of the pulse voltage output from the pulse generator circuit to the electrodes is from −650 to −50 V and the mean potential is −350 V. As described above, when the humidity is higher than the standard humidity range, the peak value of the cloud pulse is raised, which enhances the intensity of the electric field generated between the adjacent electrodes provided on the toner carrying roller 101 to raise the electrostatic force acting on the toner. Accordingly, the electric field capable of overcoming the adhesive force of the toner to cause the toner to perform hopping on the surface of the toner carrying roller 101 may be generated, thereby facilitating the toner to perform hopping and inhibiting the decrease in the amount of toner attached to the latent image portion formed on the surface of the photoreceptor drum to lower the image intensity.

If, on the other hand, the image forming operation is conducted under a low-humidity environment, adhesive force between the toner and the surface of the toner carrying roller 101 may be decreased due to a decrease in liquid cross-linking force, or the electrostatic force generated by the electric field acting on the toner may be increased due to an increase in a charging amount of the toner resulting from increased toner charging efficiency. Accordingly, the toner is hopping too much to jump up too high above the toner carrying member (toner carrying roller 101), which may contaminate the base surface of the image carrying member or reduce an allowable contamination range of the base surface of the image carrying member due to an increase in a jumping height of the toner cloud formed on and above the toner carrying roller 101. That is, toner may be undesirably attached to the non-image forming portion (base surface region) of the photoreceptor drum surface where no electrostatic latent image is formed. Thus, the jumping height of the toner is controlled by lowering the peak value of the cloud pulse such that the jumping height of the toner is not so much high.

For example, if the humidity detected by the humidity sensor 40 is lower than the initially set standard humidity range (YES in step S5), the control unit determines that the copier or developing device 1 is under the low-humidity environment (step S6) and lowers the peak value of the pulse voltage output by the power source 31 from 500 to 400 V based on a control signal received from the control unit (step S7). If the DC bias voltage of the power source 32 is −650 V in the same manner as the bias voltage under the standard-humidity environment, the peak value of the pulse voltage output from the pulse generator circuit to the electrodes is from −650 to −250 V and the mean potential range is −450 V. As described above, when the humidity is lower than the standard humidity range, the peak value of the cloud pulse is lowered, which reduces the intensity of the electric field generated between the adjacent electrodes provided on the toner carrying roller 101 to reduce the electrostatic force acting on the toner. Accordingly, toner may be prevented from hopping too much to jump up too high on the surface of the toner carrying roller 101 to thereby result in undesired toner adhering to the non-image forming portion (base surface) of the photoreceptor drum surface where no electrostatic latent image is formed.

Further, if the humidity of the environment detected by the humidity sensor 40 provided inside the developing device 1 is not higher than the initially set standard humidity range (NO in step S2) and is not lower than the initially set standard humidity range (NO in step S5), the control unit determines that the copier or developing device is under the standard-humidity environment, thereby terminating the sequence of control operations.

Figure 13:
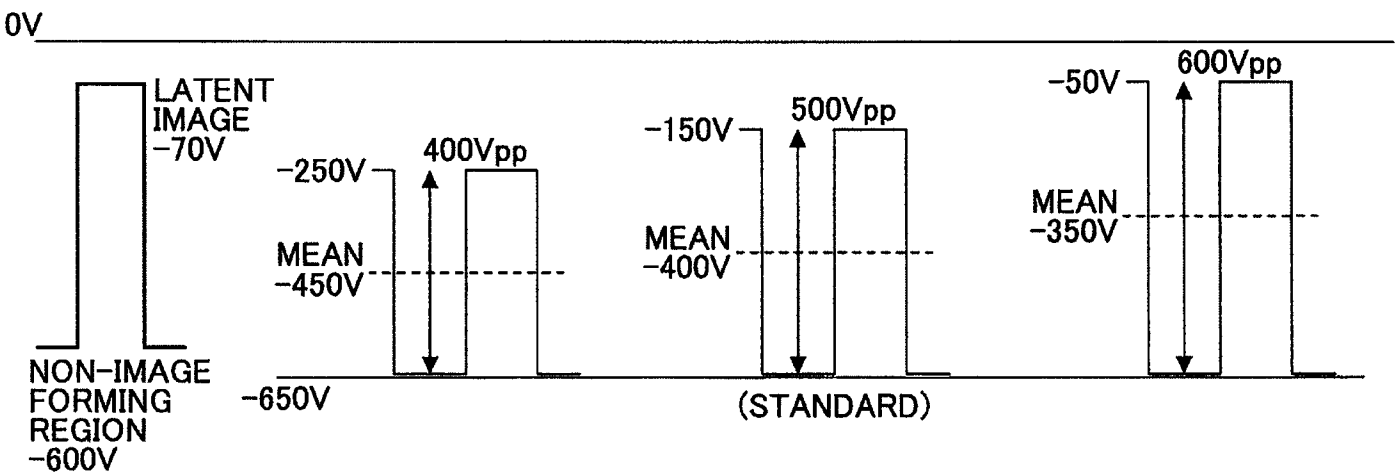
FIG. 13 is a waveform diagram when a peak interval voltage (peak-to-peak voltage) of the cloud pulse is changed to 400 Vpp, 500 Vpp, and 600 Vpp while a low side peak value of the cloud pulse is constant (−650 V)

FIG. 13 is a waveform diagram obtained when a peak interval voltage (peak-to-peak voltage) is correspondingly changed to 400 Vpp, 500 Vpp, and 600 Vpp while a lower side peak value of the cloud pulse is constant (−650 V).

Figure 14A:
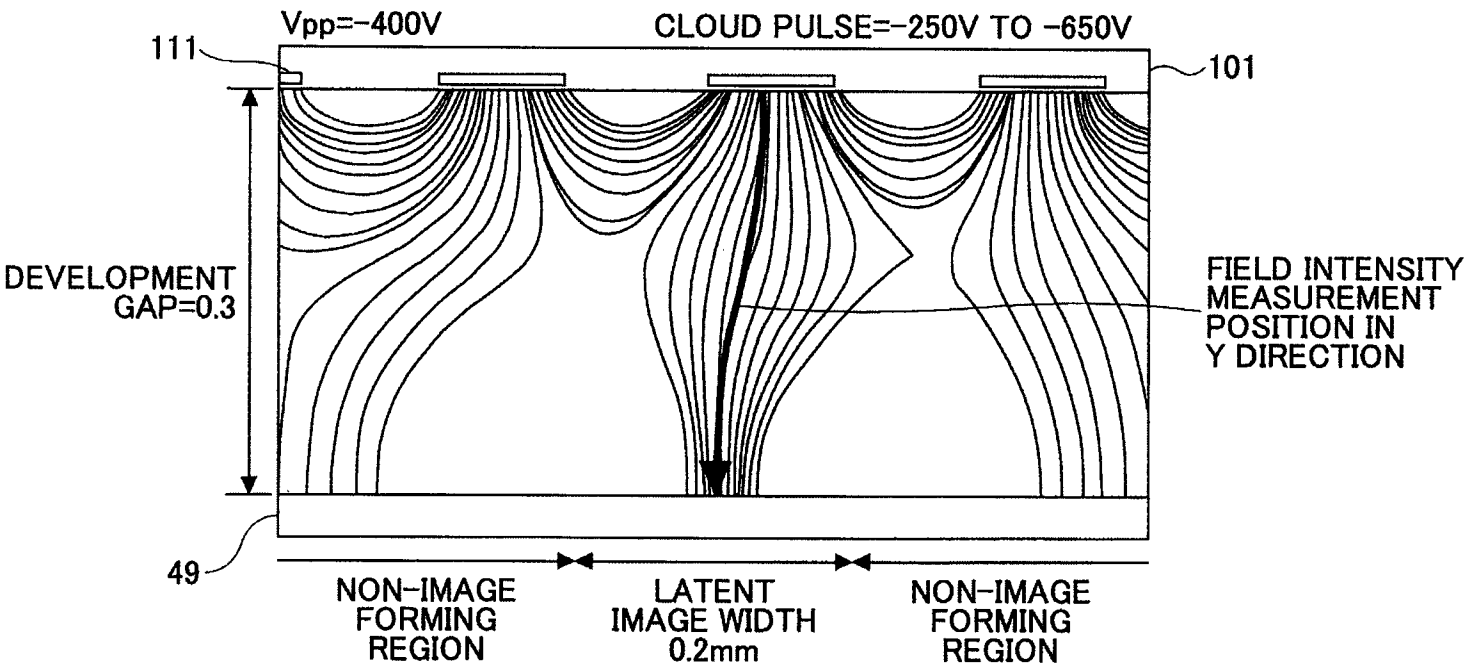
FIG. 14A is a diagram plotting electric lines of force based on a simulation result of field intensity between the photoreceptor drum and the toner carrying roller when the peak interval voltage of the cloud pulse is 400 Vpp with a cloud pulse voltage of −250 to −650 V.
Figure 14B:
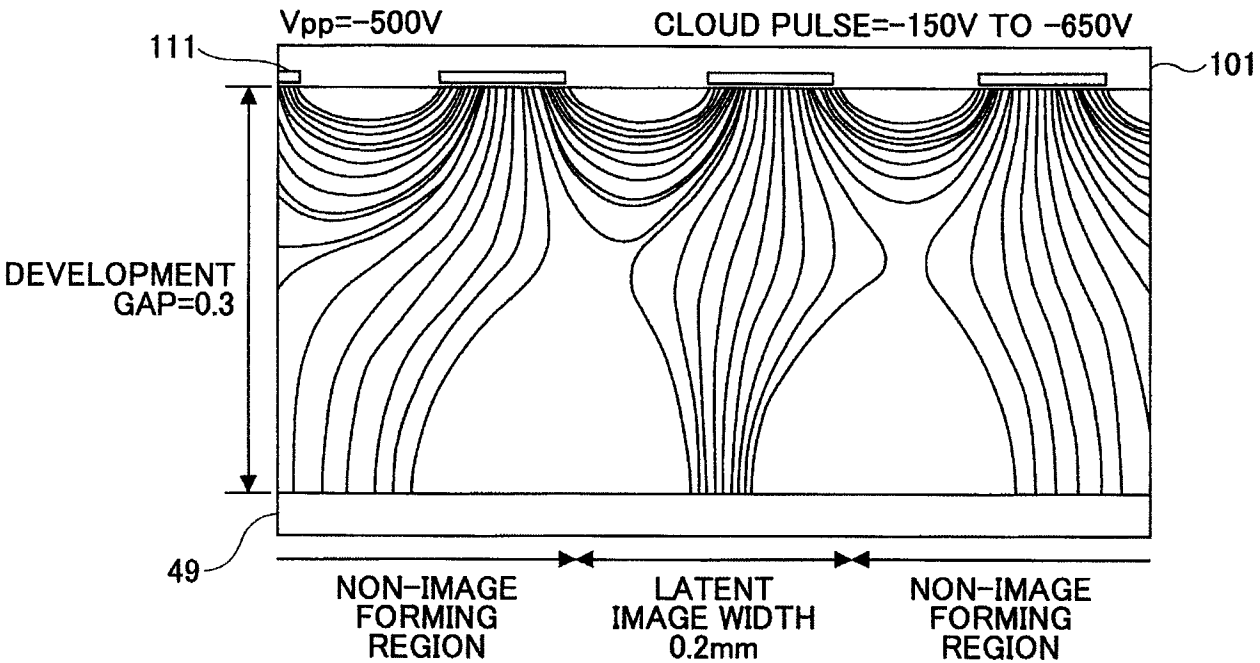
FIG. 14B is a diagram plotting electric lines of force based on a simulation result of field intensity between the photoreceptor drum and the toner carrying roller when the peak interval voltage of the cloud pulse is 500 Vpp with a cloud pulse voltage of −150 to −650 V.
Figure 14C:
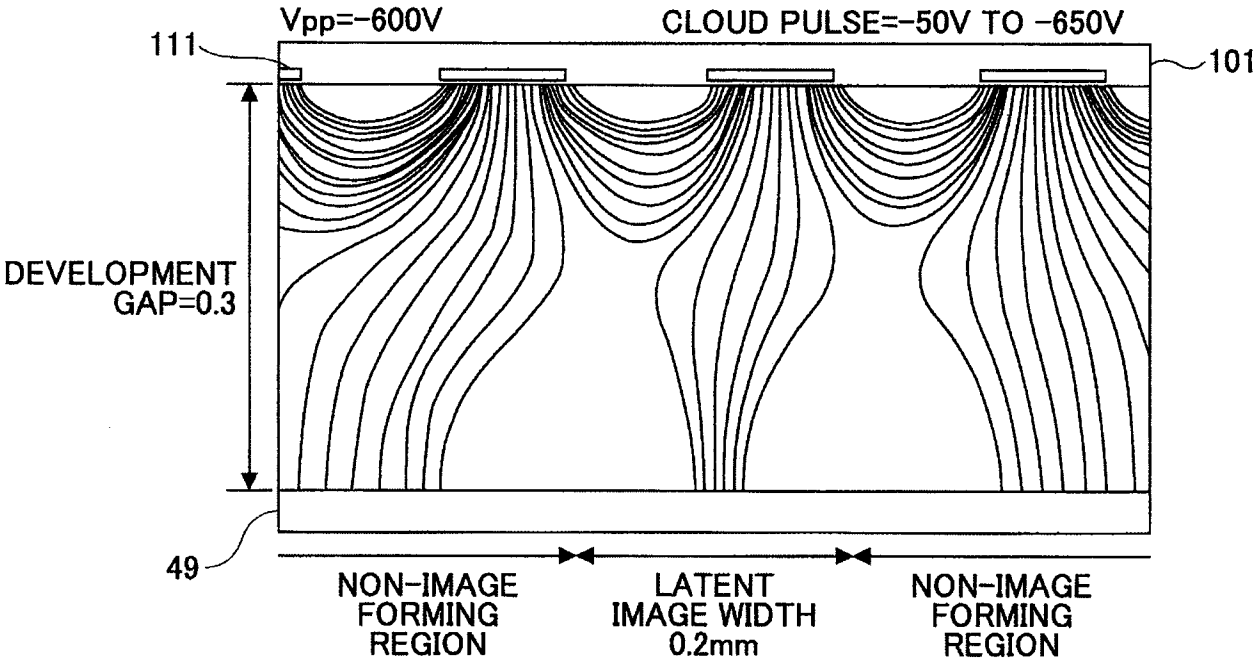
FIG. 14C is a diagram plotting electric lines of force based on a simulation result of field intensity between the photoreceptor drum and the toner carrying roller when the peak interval voltage of the cloud pulse is 600 Vpp with a cloud pulse voltage of −50 to −650 V.

FIG. 14A is a diagram plotting electric lines of force formed based on a simulation result of field intensity between the photoreceptor drum 49 and the toner carrying roller 101 when the peak interval voltage of the cloud pulse is 400 Vpp with a cloud pulse of −250 to −650 V. FIG. 14B is a diagram plotting electric lines of force formed based on a simulation result of field intensity between the photoreceptor drum 49 and the toner carrying roller 101 when the peak interval voltage of the cloud pulse is 500 Vpp with a cloud pulse of −150 to −650 V. FIG. 14C is a diagram plotting electric lines of force formed based on a simulation result of field intensity between the photoreceptor drum 49 and the toner carrying roller 101 when the peak interval voltage of the cloud pulse is 600 Vpp with a cloud pulse of −50 to −650 V.

The cloud electrodes for the A-phase (positive) and those for the B-phase (negative or reversed phase) are alternately formed on the surface of the toner carrying roller 101 with a width of the electrode of 100 μm and an interval between the adjacent electrodes of 100 μm. As illustrated in FIGS. 14A to 14C, a latent image width of the latent image portion of the photoreceptor drum 49 is 0.2 mm. The latent image portion is exposed based on image information on the surface of the photoreceptor drum 49 facing the toner carrying roller 101, and a portion of the photoreceptor drum 49 other than the latent image portion is a non-image forming portion (base surface region). The charging potential of the non-image forming portion (base surface region) of the photoreceptor drum 49 is −600 V, and the charging potential of the latent image portion is −70 V. A development gap is 0.3 mm, which is a gap between the surface of the toner carrying roller 101 and the surface of the photoreceptor drum 49. Note that lines of electric force illustrated in FIGS. 14A, 14B, and 14C are the lines of electric force across the cloud electrode surface of the toner carrying roller 101 at a position 20 μm from the cloud electrode surface of the toner carrying roller 101 in an upward direction, and the lines of electric force other than the lines of electric force across the cloud electrode surface of the toner carrying roller 101 at a position 20 μm from the cloud electrode surface of the toner carrying roller 101 in an upward direction are omitted.

Figure 15:
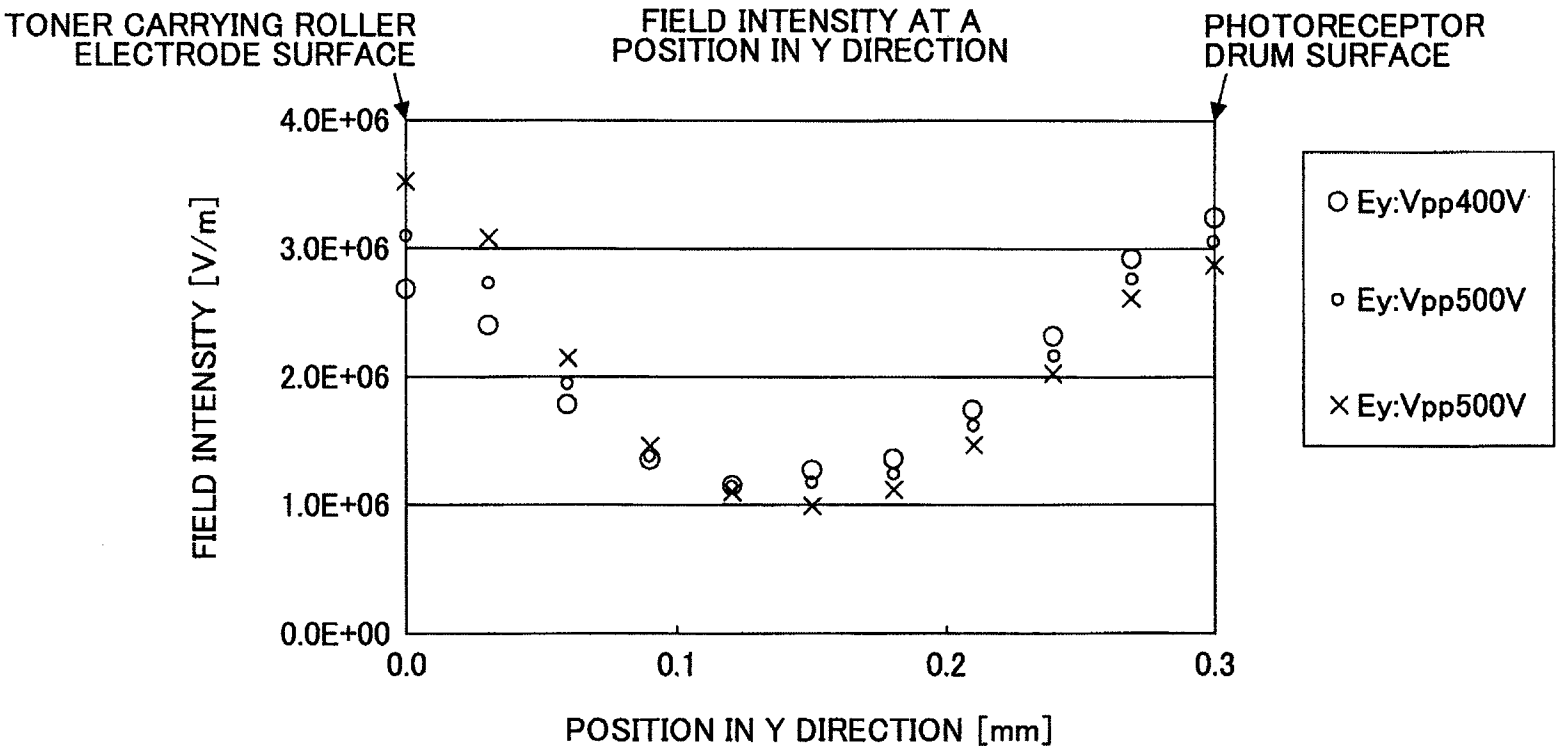
FIG. 15 is a graph illustrating field intensity at a corresponding position in a development gap between the photoreceptor drum and the toner carrying roller in a Y direction for each of the examples in FIGS. 14A, 14B, and 14C.

FIG. 15 is a graph illustrating field intensity obtained at a position in a development gap between the photoreceptor drum 49 and the toner carrying roller 101 in a Y direction corresponding to examples in FIGS. 14A, 14B, and 14C. The illustrated field intensity is obtained at a position connecting a central portion of the latent image where the greatest potential difference is obtained to an electrode central portion where a low cloud pulse potential is applied in the Y direction.

As illustrated in FIG. 15, when a peak interval voltage (peak-to-peak voltage) is correspondingly changed to 400 Vpp, 500 Vpp, and 600 Vpp while a lower side peak value of the cloud pulse is constant (−650 V), the field intensity is higher with the high peak value of the cloud pulse than with the low peak value of the cloud pulse in a region near the cloud electrodes (i.e., near toner carrying roller electrode surface). However, the field intensity is lower with the high peak value of the cloud pulse than with the low peak value of the cloud pulse in a region near the field intensity near the photoreceptor drum surface. As a result, uniform image intensity may be obtained as a development result. Accordingly, in order to obtain the uniform image intensity even if the peak value of the cloud pulse is changed, it is effective to control the voltage for repelling toner applied to the cloud electrodes (voltage at a low peak value of the cloud pulse), which provides a high effect on toner jetting properties.

Figure 16:
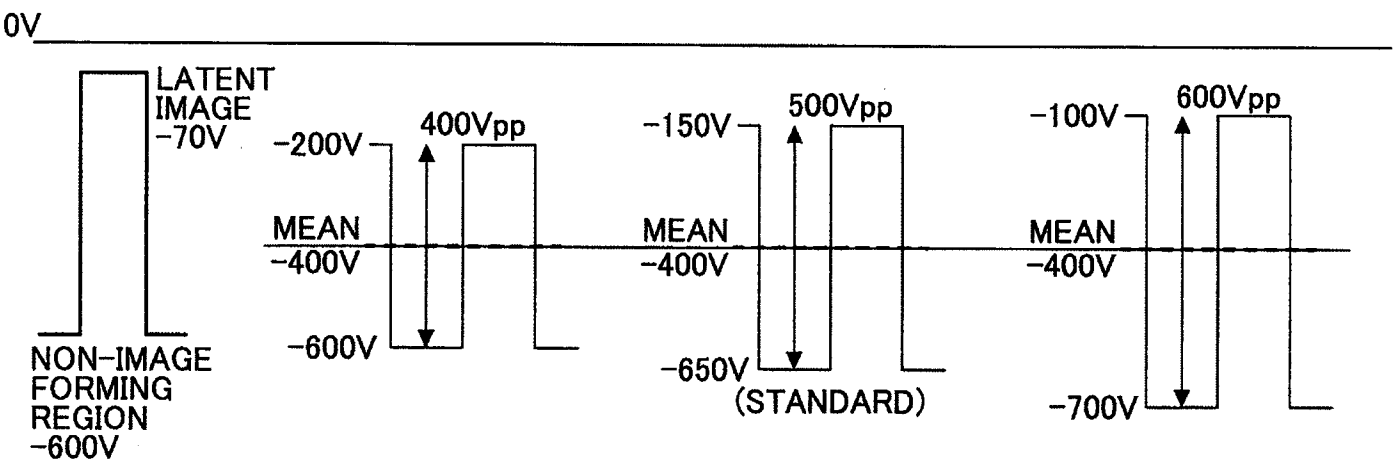
FIG. 16 is a waveform diagram when a peak interval voltage (peak-to-peak voltage) is changed to 400 Vpp (cloud pulse voltage of −200 to −600 V), 500 Vpp (cloud pulse voltage of −150 to −650 V), and 600 Vpp (cloud pulse voltage of −100 to while a mean of peak values of the cloud pulse voltages is constant (−400 V)

FIG. 16 is a waveform diagram obtained when a peak interval voltage (peak-to-peak voltage) is correspondingly changed to 400 Vpp (cloud pulse of −200 to −600 V), 500 Vpp (cloud pulse of −150 to −650 V), and 600 Vpp (cloud pulse of −100 to −700 V) while a mean of peak values of the cloud pulse voltages is constant (−400 V).

Figure 17:
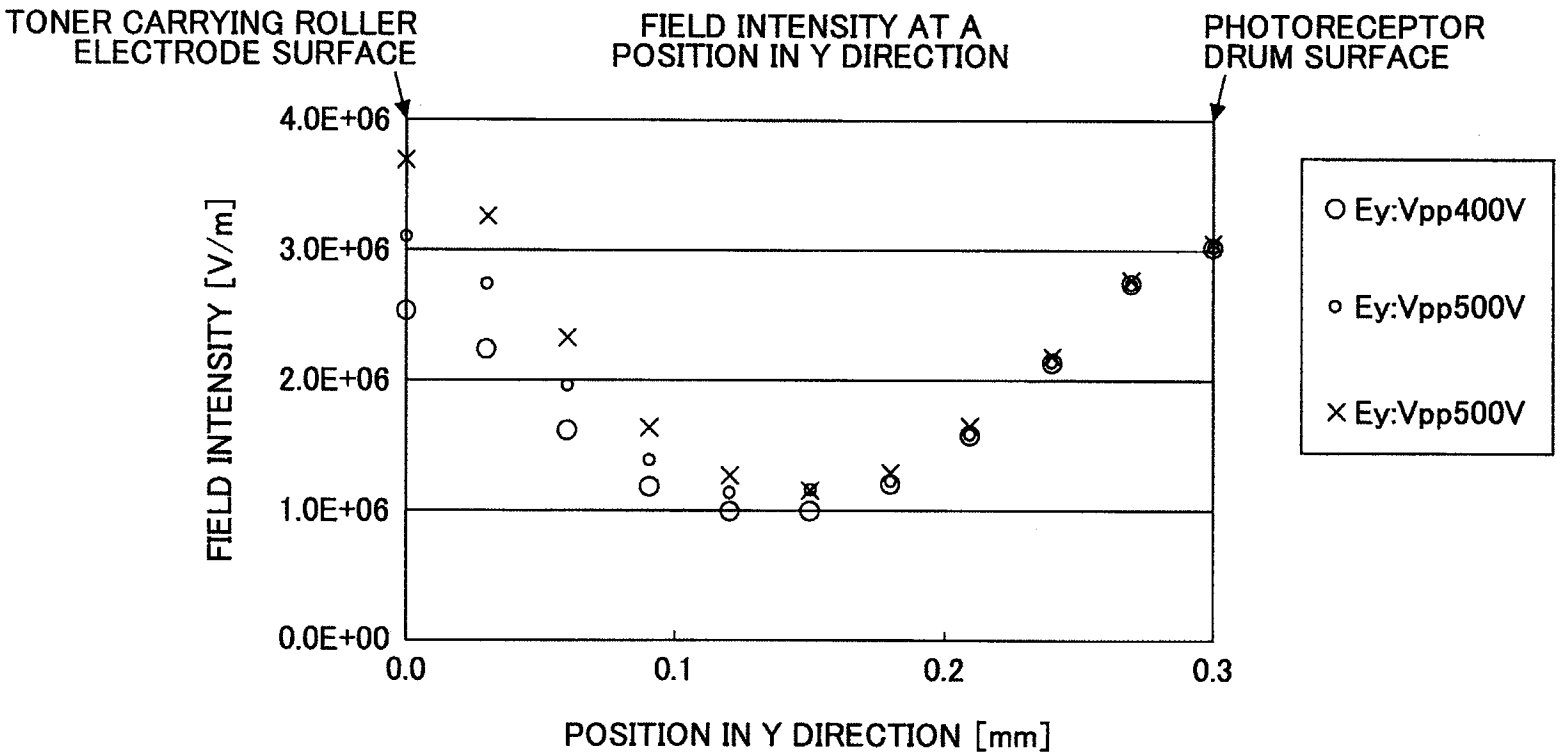
FIG. 17 is a graph illustrating field intensity at a position in a development gap between the photoreceptor drum and the toner carrying roller in a Y direction for corresponding waveform examples illustrated in FIG. 16.

FIG. 17 is a graph illustrating field intensity at a position in a development gap between the photoreceptor and the toner carrying roller in a Y direction of corresponding waveform examples illustrated in FIG. 16. As illustrated in FIG. 17, when the mean of the peak values of the cloud pulse voltages is made constant, the field intensity is higher with the high cloud pulse peak value than with the low cloud pulse peak value in a region near the cloud electrode surface (i.e., near toner carrying roller electrode surface). However, the field intensity near the photoreceptor drum surface remains unchanged. As a result, the image intensity is higher with the high peak value of the cloud pulse than with the low peak value of the cloud pulse.

Figure 18A:
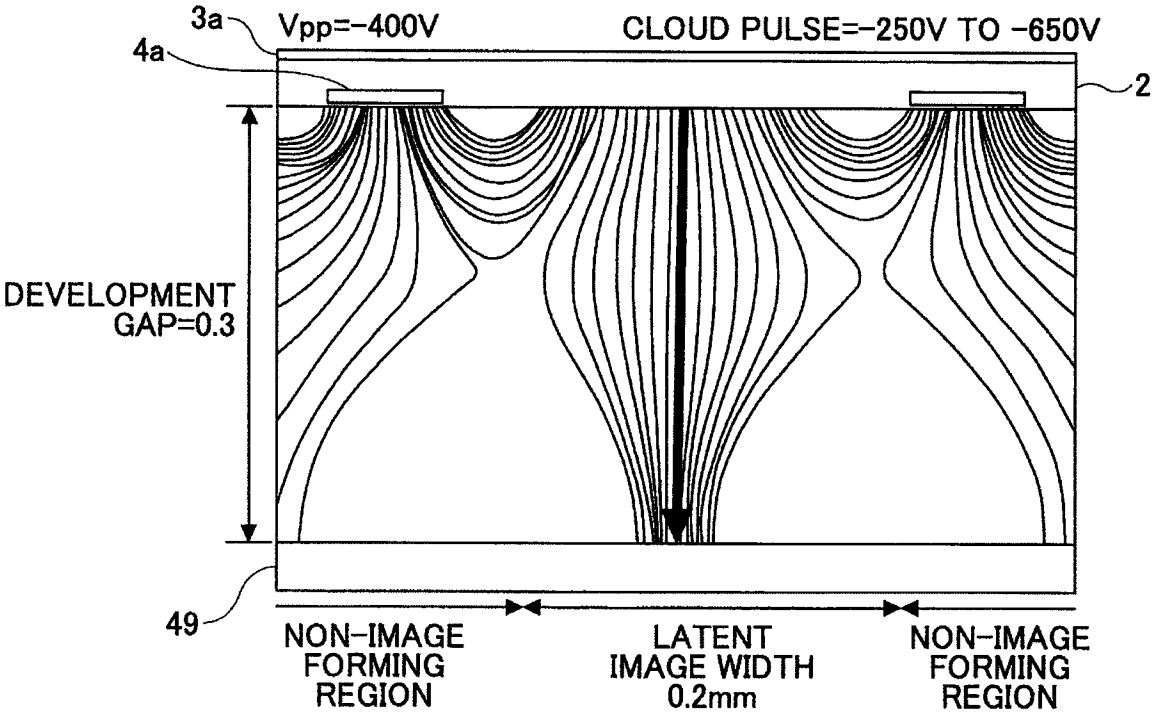
FIG. 18A is a diagram plotting electric lines of force based on a simulation result of field intensity between the photoreceptor drum and the toner carrying roller when the peak interval voltage is 400 Vpp with a cloud pulse voltage of −250 to −650 V.
Figure 18B:
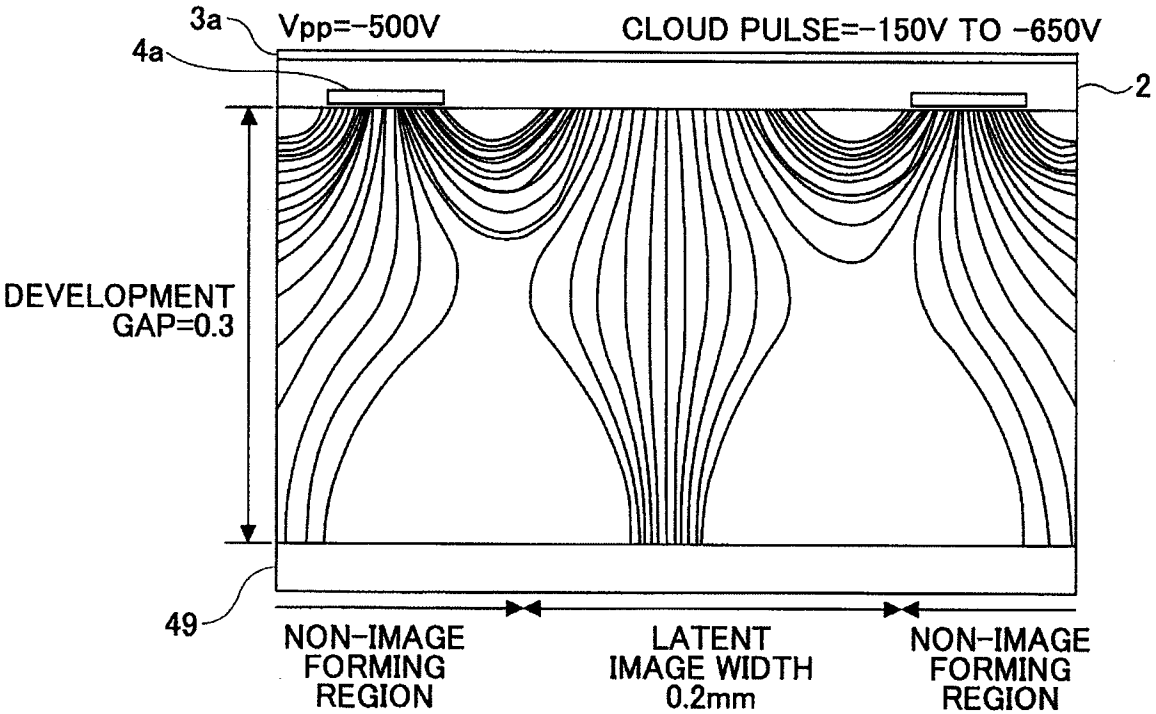
FIG. 18B is a diagram plotting electric lines of force based on a simulation result of field intensity between the photoreceptor drum and the toner carrying roller when the peak interval voltage of the cloud pulse is 500 Vpp with a cloud pulse voltage of −150 to −650 V.
Figure 18C:
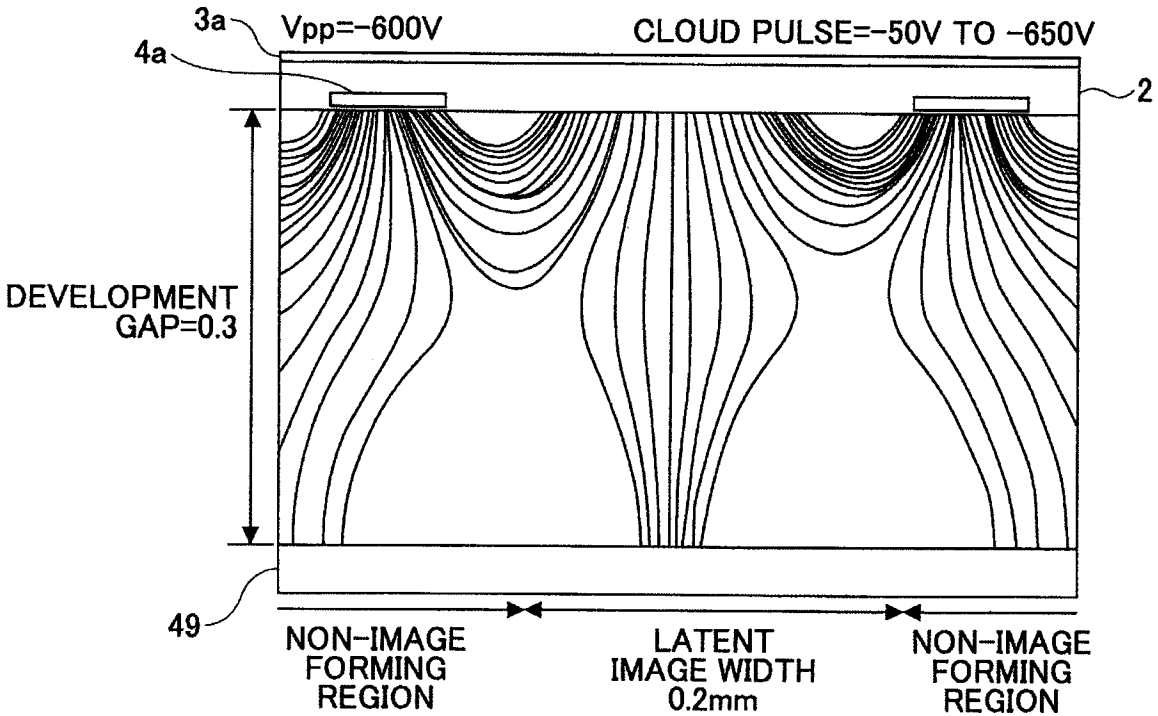
FIG. 18C is a diagram plotting electric lines of force based on a simulation result of field intensity between the photoreceptor drum and the toner carrying roller when the peak interval voltage of the cloud pulse is 600 Vpp with a cloud pulse voltage of −50 to −650 V.

FIG. 18A is a diagram plotting electric lines of force formed based on a simulation result of field intensity between the photoreceptor drum 49 and the toner carrying roller 2 illustrated in FIGS. 16 A and 16B when the peak interval voltage of the cloud pulse is 400 Vpp with a cloud pulse of −250 to −650 V. FIG. 18B is a diagram plotting electric lines of force formed based on a simulation result of field intensity between the photoreceptor drum 49 and the toner carrying roller 2 illustrated in FIGS. 16A and 16B when the peak interval voltage of the cloud pulse is 500 Vpp with a cloud pulse of −150 to −650 V. FIG. 18C is a diagram plotting electric lines of force formed based on a simulation result of field intensity between the photoreceptor drum 49 and the toner carrying roller 2 illustrated in FIGS. 16 A and 16B when the peak interval voltage of the cloud pulse is 600 Vpp with a cloud pulse of −50 to −650 V.

In these examples, the inner electrode 3*a* is made of an aluminum tube so that an entire surface of the aluminum tube functions as a conductor. The insulator layer 5 having a thickness of 10 to 20 μm (16 μm in the simulation in FIGS. 18A, 18B, and 18C) is provided on a surface of the aluminum tube (i.e., inner electrode 3*a*), the outer electrode 4*a* having a width of 100 μm with an interval of 300 μm is provided on a surface of the insulator layer 5, and an insulator coating layer of 15 μm is provided on an outermost surface of the toner carrying roller 2. The relative dielectric constant of each insulator layer in the examples is $\in r=3$.

In this process, if the cloud pulse is from −250 to −650 V in FIG. 18A, from −150 to −650 V in FIG. 18B, and from −50 to −650 V in FIG. 18C, the obtained result is similar to the result of FIG. 15 that is obtained with the toner carrying roller 101 illustrated in FIG. 4. Accordingly, approximately uniform image intensity may be obtained by controlling the toner repelling voltage applied to the cloud electrodes (voltage at a low peak value of the cloud pulse) to be constant.

Thus, when the humidity environment is higher than the standard-humidity environment, the electric field capable of causing the toner to perform excellent hopping, which is obtained by overcoming the adhesive force such as the above liquid cross-linking force between the toner and the surface of the toner carrying roller, is generated by raising the peak value of the cloud pulse. For example, if the DC bias voltage of the power source 32 is −650 V and the peak value of the pulse voltage generated by the power source 31 is increased from the standard-humidity environment voltage of 500 V to 600 V, the peak value of the pulse voltage output from the pulse generator circuit is from −650 to −50 V. However, since the DC bias voltage of the power source 32 is constant, the potential of the toner repelling voltage applied to the cloud electrodes (voltage at a low peak value of the cloud pulse) is a constant voltage of −650 V, thereby stabilizing the image intensity.

On the other hand, when the humidity environment is lower than the standard-humidity environment, the adhesive force of the toner may be decreased due to an increase in the jumping height of the toner cloud on or above the toner carrying roller surface, thereby reducing an allowable contamination range of the base surface (i.e., non-image forming portion) of the toner carrying roller surface. Accordingly, the peak value of the cloud pulse is lowered. For example, if the DC bias voltage of the power source 32 is −650 V and the peak value of the pulse voltage generated by the power source 31 is decreased from the standard-humidity environment voltage of 500 V to 400 V, the peak value of the pulse voltage output from the pulse generator circuit is from −650 to −250 V. However, since the DC bias voltage of the power source 32 is constant, the potential of the toner repelling voltage applied to the cloud electrodes (voltage at a low peak value of the cloud pulse) is a constant voltage of −650 V, thereby stabilizing the image intensity.

Figure 19:
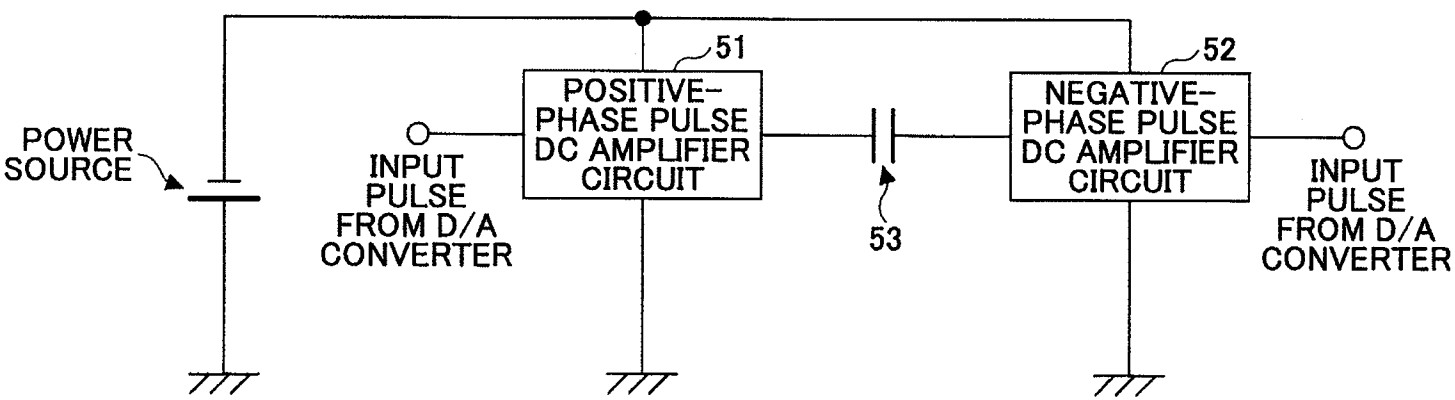
FIG. 19 is a schematic diagram illustrating a configuration of a cloud pulse generator circuit used as a comparative example.

FIG. 19 illustrates a comparative example of a configuration of a pulse voltage application unit. In this comparative example, since the signal applied to the cloud electrode of the toner carrying roller needs to include the cloud pulse and the DC bias pulse, the pulse signals including the low DC voltages are generated from not shown D/A converters, which are amplified around 300 V to 600 V by a DC amplifier circuit having a feedback circuit configuration composed of the positive pulse DC amplifier circuit 51 and the negative pulse DC amplifier circuit 51, and applied to both ends of an electrode load 53. In this case, the circuit cost may be increased and the current drift of the amplifier circuits due to temperature change may obtained. Moreover, fluctuation in the amplification factor due to temperature change with time may change the pulse peak value and the DC bias voltage, thereby affecting cloud properties and degrading the image intensity quality. In addition, there may be provided the pulse voltage application unit having a circuit configuration in which the high-voltage pulse is generated by a transformer and the high-voltage pulse is applied simultaneously with the application of the DC bias. However, this configuration may result in increases in sizes of circuit components, an increase in cost, and an increase in loss of electric power. By contrast, since the pulse voltage application unit 30 has a configuration illustrated in FIGS. 1 and 11, where switching circuits are provided in place of the DC amplifier circuits, the pulse voltage application unit 30 has less number of components than the pulse voltage application unit provided with the DC amplifier circuits and has a stable output level. Accordingly, high reliability in the image intensity quality may be obtained with the reduction in sizes of components and the reduction in cost. Further, a DC component adjustment for developing bias adjustment (adjustment of the mean of the pulse voltage) may not be achieved by the switching circuit alone; however, the configuration of the pulse voltage application unit 30 according to the embodiment may facilitates the DC component adjustment for developing bias adjustment. Thus, the pulse voltage application unit 30 according to the embodiment may be capable of reducing various disadvantages obtained in the related art technologies.

As described above, the embodiment of the invention may provide a developing device that includes: a toner carrying roller used as a toner carrying member having plural electrodes; a toner supply roller used as a toner supply unit configured to supply the toner on a surface of the toner carrying member; and a cloud voltage application unit used as a hopping electric field generator unit configured to generate, when the toner is carried in a developing region facing a photoreceptor drum used as a latent image carrying member, electric field for causing the toner to perform hopping on the surface of the toner carrying roller by applying a pulse voltage to the plural electrodes carried thereon to attach the toner to a latent image on the photoreceptor drum. In the developing device, the cloud voltage application unit includes: a cloud pulse generator circuit used as a pulse voltage generator circuit configured to generate the pulse voltage; the power source 31 used as a first direct-current power source electrically disconnected from a ground and configured to supply bias for regulating a peak value of the pulse voltage to the pulse voltage generator circuit; and the power source 32 used as a second minus direct-current power source provided between a low level side of the power source 31 and the ground, and configured to output a variable voltage level. When toner charged with a minus polarity is used, the cloud voltage application unit changes the output level of the power source 32 based on an image density signal of an image on the photoreceptor drum output from an image density detector provided in an image forming apparatus. With this configuration, the image density may be maintained at a constant level.

In addition, the embodiment of the invention may provide a developing device that includes: a toner carrying roller used as a toner carrying member having plural electrodes; a toner supply roller used as a toner supply unit configured to supply the toner on a surface of the toner carrying member; and a cloud voltage application unit used as a hopping electric field generator unit configured to generate, when the toner is carried in a developing region facing a photoreceptor drum used as a latent image carrying member, electric field for causing the toner to perform hopping on the surface of the toner carrying roller by applying a pulse voltage to the plural electrodes carried thereon to attach the toner to a latent image on the photoreceptor drum. In the developing device, the cloud voltage application unit includes: a cloud pulse generator circuit used as a pulse voltage generator circuit configured to generate the pulse voltage; the power source 31 used as a first direct-current power source electrically disconnected from a ground and configured to supply bias for regulating a peak value of the pulse voltage to the pulse voltage generator circuit; and the power source 32 used as a second plus direct-current power source provided between a low level side of the power source 31 and the ground, and configured to output a variable voltage level. When toner charged with a plus polarity is used, the cloud voltage application unit changes the output level of the power source 32 based on an image density signal of an image on the photoreceptor drum output from an image density detector provided in an image forming apparatus. With this configuration, the image density may be maintained at a constant level. Further, in the developing device, the power source 31 is configured to output a variable voltage level based on the applied bias. With this configuration, the peak value of the cloud pulse and the DC bias value may be separately controlled by changing the output level of the bias to the power source 31 with a simple circuit configuration.

In addition, the embodiment of the invention may provide a developing device that includes: a first set of a first switching element Q1, a second switching element Q2, a first current regulating resistor and a second current regulating resistor that are serially connected between a first and second terminals of the power source 31; a second set of a third switching element Q3, a fourth switching element Q4, a third current regulating resistor and a fourth current regulating resistor that are serially connected between a third and fourth terminals of the power source 31, the second set connected in parallel to the first set; a first group of electrodes provided on the toner carrying member connected between the first switching element and second switching element; and a second group of electrodes provided on the toner carrying member connected between the third switching element and the fourth switching element to form a bridge configuration. In the developing device, a positive-phase cloud pulse is applied by turning the first switching element Q1 and the fourth switching element Q4 on, and a negative-phase cloud pulse is applied by turning the second element Q2 and the third switching element Q3 on. Accordingly, the toner repeats hopping between the first electrode group and second electrode group to thereby form a toner cloud on the toner carrying roller surface.

Further, the embodiment of the invention may provide a process cartridge including a development unit and at least one of an image carrying member, a charging device, and a cleaning device. The process cartridge is detachably attached to an image forming apparatus. In the process cartridge, since various effects described above may be obtained, it is preferable that the developing device 1 be used as the development unit.

In addition, the embodiment of the invention may provide an image forming apparatus that includes a developing unit configured to supply a developer to a latent image formed on the photoreceptor drum 49 to obtain a developed image and finally transfer the developed image on a recording medium. In the image forming apparatus, since various effects described above may be obtained, it is preferable that the developing device 1 be used as the development unit. As a result, an excellent image forming operation may be carried out.

Further, the embodiment of the invention may provide an image forming apparatus having a process cartridge that includes a development unit and at least one of the photoreceptor drum 49, the charging device 50 and the cleaning device 45, and is detachably attached to an image forming apparatus. In the image forming apparatus, since various effects described above may be obtained, it is preferable that a process cartridge having the developing device 1 according to the embodiment be used as the process cartridge. Further, it is preferable that a color image forming apparatus includes plural process cartridges described above.

According to the embodiment, since the peak value of the pulse voltage is controlled by changing the output level of the first power source and the mean of the pulse voltage is controlled by changing an output level of the second power source, the peak value of the pulse voltage and the mean of the pulse voltage may be separately controlled. Accordingly, the mean of the pulse voltage may be easily changed into a desirable value when the peak value of the pulse voltage is changed. Thus, the field intensity near the surface of the latent image carrying member is changed due to the difference in the mean of the pulse voltage before and after the peak value of the pulse voltage applied to the hopping electrodes is changed, and the density of the image formed on the latent image carrying member is changed based on the change in the field intensity near the surface of the latent image carrying member.

As described above, the embodiment of the invention is capable of providing the effect of changing the image density formed on the latent image carrying member when the peak value of the pulse voltage is changed.

Embodiments of the present invention have been described heretofore for the purpose of illustration. The present invention is not limited to these embodiments, but various variations and modifications may be made without departing from the scope of the present invention. The present invention should not be interpreted as being limited to the embodiments that are described in the specification and illustrated in the drawings.

The present application is based on Japanese priority applications No. 2009-211499 filed on Sep. 14, 2009, and No. 2009-277640 filed on Dec. 7, 2009, with the Japanese Patent Office, the entire contents of which are hereby incorporated by reference.

What is claimed is:

1. A developing device comprising:

a toner carrying member having plural electrodes;

a toner supply unit configured to supply toner on a surface of the toner carrying member; and a hopping electric field generator unit configured to generate, when the toner is carried in a developing region facing a latent image carrying member, an electric field to cause the toner to perform hopping on the surface of the toner carrying member by applying a pulse voltage to the plural electrodes carried thereon to attach the toner to a latent image on the latent image carrying member, wherein the hopping electric field generator unit includes:

a pulse voltage generator circuit configured to generate the pulse voltage;

a first direct-current power source electrically floating from a ground and configured to supply bias to regulate a peak value of the pulse voltage to the pulse voltage generator circuit; and a second direct-current power source provided between a low level side of the first direct-current power source and the ground and having a same polarity as a charging polarity of the toner, and configured to output a variable voltage level, wherein the hopping electric field generator unit controls the peak value of the pulse voltage by changing an output level of the first power source, and controls a mean of the pulse voltage by changing an output level of the second power source.

2. The developing device as claimed in claim 1, wherein the output level of the second power source is changed based on an amount of a change in the output level of the first power source.

3. The developing device as claimed in claim 1, wherein an amount of a change in the output level of the second power source is half an amount of the change in the output level of the first power source.

4. The developing device as claimed in claim 1, wherein the hopping electric field generator unit controls the mean of the pulse voltage by changing the output level of the second power source such that the mean of the pulse voltage is a predetermined constant value.

5. The developing device as claimed in claim 1, further comprising:

a humidity detector configured to detect humidity; and a control unit configured to reduce intensity of the electric field to cause the toner to perform hopping on the surface of the toner carrying member when a detected result of the humidity detector indicates a first humidity, and to raise the intensity of the electric field to cause the toner to perform hopping on the surface of the toner carrying member when the detected result of the humidity detector indicates a second humidity greater than the first humidity.

6. The developing device as claimed in claim 1, further comprising:

a control unit configured to reduce intensity of the electric field to cause the toner to perform hopping on the surface of the toner carrying member when image density is increased, and to raise the intensity of the electric field to cause the toner to perform hopping on the surface of the toner carrying member when the image density is reduced, based on an image density signal of an image on an image carrying member output from an image density detector provided in an image forming apparatus.

7. The developing device as claimed in claim 1, wherein the pulse voltage generator circuit includes:

a first set of a first switching element, a second switching element, a first current regulating resistor and a second current regulating resistor that are serially connected between first and second terminals of the first power source;

a second set of a third switching element, a fourth switching element, a third current regulating resistor, and a fourth current regulating resistor that are serially connected between third and fourth terminals of the first power source, the second set connected in parallel to the first set;

a first group of electrodes provided on the toner carrying member connected between the first switching element and second switching element; and a second group of electrodes provided on the toner carrying member connected between the third switching element and the fourth switching element to form a bridge configuration, and wherein a positive-phase cloud pulse is applied by turning the first switching element and the fourth switching element on, and a negative-phase cloud pulse is applied by turning the second element and the third switching element on.

8. The developing device as claimed in claim 1, wherein the first power source includes a primary circuit at a high level side thereof and a secondary circuit at the low level side thereof, the primary circuit being electrically isolated from the secondary circuit, and the secondary circuit being a floating ground circuit.

9. An image forming apparatus comprising:

a developing device configured to supply a developer to a latent image formed on a latent image carrying member to obtain a developed image and to finally transfer the developed image to a recording medium, wherein the developing device includes:

a toner carrying member having plural electrodes;

a toner supply unit configured to supply toner on a surface of the toner carrying member; and a hopping electric field generator unit configured to generate, when the toner is carried in a developing region facing the latent image carrying member, an electric field to cause the toner to perform hopping on the surface of the toner carrying member by applying a pulse voltage to the plural electrodes carried thereon to attach the toner to the latent image on the latent image carrying member, wherein the hopping electric field generator unit includes:

a pulse voltage generator circuit configured to generate the pulse voltage;

a first direct-current power source electrically floating from a ground and configured to supply bias to regulate a peak value of the pulse voltage to the pulse voltage generator circuit; and a second direct-current power source provided between a low level side of the first power source and the ground and having a same polarity as a charging polarity of the toner, and configured to output a variable voltage level, and wherein the hopping electric field generator unit controls the peak value of the pulse voltage by changing an output level of the first power source, and controls a mean of the pulse voltage by changing an output level of the second power source.

10. The image forming apparatus as claimed in claim 9, wherein the output level of the second power source is changed based on an amount of a change in the output level of the first power source.

11. The image forming apparatus as claimed in claim 9, wherein an amount of a change in the output level of the second power source is half an amount of the change in the output level of the first power source.

12. The image forming apparatus as claimed in claim 9, wherein the hopping electric field generator unit controls the mean of the pulse voltage by changing the output level of the second power source such that the mean of the pulse voltage is a predetermined constant value.

13. The image forming apparatus as claimed in claim 9, wherein the hopping electric field generator unit includes a humidity detector configured to detect humidity; and a control unit configured to reduce intensity of the electric field to cause the toner to perform hopping on the surface of the toner carrying member when a detected result of the humidity detector indicates a first humidity, and to raise the intensity of the electric field to cause the toner to perform hopping on the surface of the toner carrying member when the detected result of the humidity detector indicates a second humidity greater than the first humidity.

14. The image forming apparatus as claimed in claim 9, wherein the hopping electric field generator unit includes a control unit configured to reduce intensity of the electric field to cause the toner to perform hopping on the surface of the toner carrying member when image density is increased, and to raise the intensity of the electric field to cause the toner to perform hopping on the surface of the toner carrying member when the image density is reduced, based on an image density signal of an image on an image carrying member output from an image density detector provided in the image forming apparatus.

15. The image forming apparatus as claimed in claim 9, wherein the pulse voltage generator circuit includes:

a first set of a first switching element, a second switching element, a first current regulating resistor, and a second current regulating resistor that are serially connected between first and second terminals of the first power source;

a second set of a third switching element, a fourth switching element, a third current regulating resistor, and a fourth current regulating resistor that are serially connected between third and fourth terminals of the first power source, the second set connected in parallel to the first set;

a first group of electrodes provided on the toner carrying member connected between the first switching element and second switching element; and a second group of electrodes provided on the toner carrying member connected between the third switching element and the fourth switching element to form a bridge configuration, and wherein a positive-phase cloud pulse is applied by turning the first switching element and the fourth switching element on, and a negative-phase cloud pulse is applied by turning the second element and the third switching element on.

16. The image forming apparatus as claimed in claim 9, wherein the first power source includes a primary circuit at a high level side thereof and a secondary circuit at the low level side thereof, the primary circuit being electrically isolated from the secondary circuit, and the secondary circuit being a floating ground circuit.

17. A process cartridge comprising:

a developing device; and at least one of an image carrying member, a charging device, and a cleaning device, the process cartridge detachably attached to an image forming apparatus, wherein the developing device includes:

a toner carrying member having plural electrodes;

a toner supply unit configured to supply toner on a surface of the toner carrying member; and a hopping electric field generator unit configured to generate, when the toner is carried in a developing region facing a latent image carrying member, an electric field to cause the toner to perform hopping on the surface of the toner carrying member by applying a pulse voltage to the plural electrodes carried thereon to attach the toner to a latent image on the latent image carrying member, wherein the hopping electric field generator unit includes:

a pulse voltage generator circuit configured to generate the pulse voltage;

a first direct-current power source electrically floating from a ground and configured to supply bias to regulate a peak value of the pulse voltage to the pulse voltage generator circuit; and a second direct-current power source provided between a low level side of the first direct-current power source and the ground and having a same polarity as a charging polarity of the toner, and configured to output a variable voltage level, and wherein the hopping electric field generator unit controls the peak value of the pulse voltage by changing an output level of the first power source, and controls a mean of the pulse voltage by changing an output level of the second power source.

18. The process cartridge as claimed in claim 17, wherein the hopping electric field generator unit controls the mean of the pulse voltage by changing the output level of the second power source such that the mean of the pulse voltage is a predetermined constant value.

19. The process cartridge as claimed in claim 17, wherein the first power source includes a primary circuit at a high level side thereof and a secondary circuit at the low level side thereof, the primary circuit being electrically isolated from the secondary circuit, and the secondary circuit being a floating ground circuit.

* * * * *